US009884707B2

(12) United States Patent
Cross et al.

(10) Patent No.: US 9,884,707 B2
(45) Date of Patent: Feb. 6, 2018

(54) POP-OUT CONSTRUCTIBLE UTENSIL

(71) Applicant: EcoTensil Inc., Corte Madera, CA (US)

(72) Inventors: Peggy V. K. Cross, Larkspur, CA (US); Debora Levy, San Rafael, CA (US)

(73) Assignee: EcoTensil Inc., Corte Madera, CA (US)

( * ) Notice: Subject to any disclaimer, the term of this patent is extended or adjusted under 35 U.S.C. 154(b) by 0 days.

(21) Appl. No.: 14/271,415

(22) Filed: May 6, 2014

(65) Prior Publication Data

US 2014/0332539 A1 Nov. 13, 2014

Related U.S. Application Data

(60) Provisional application No. 61/890,313, filed on Oct. 13, 2013, provisional application No. 61/820,667, filed on May 7, 2013.

(51) Int. Cl.

| | |
|---|---|
| ***B65D 51/24*** | (2006.01) |
| ***A47G 21/06*** | (2006.01) |
| ***B65D 81/32*** | (2006.01) |
| *A45C 11/20* | (2006.01) |

(52) U.S. Cl.

CPC ..... *B65D 51/247* (2013.01); *A47G 21/06* (2013.01); *B65D 51/246* (2013.01); *B65D 81/3216* (2013.01)

(58) Field of Classification Search

CPC ..... B65D 51/247; B65D 51/246; B65D 81/3216; A45G 21/06

USPC ..... 206/223, 541; 220/574.1, 212

See application file for complete search history.

(56) References Cited

U.S. PATENT DOCUMENTS

| | | | |
|---|---|---|---|
| 636,735 | A | 11/1899 | Davenport |
| 1,128,114 | A | 2/1915 | Doellinger |
| 1,521,768 | A | 1/1925 | Herrmann |
| 1,625,335 | A | 4/1927 | Schneider |
| 1,633,605 | A | 6/1927 | Prudden |
| 1,657,325 | A | 1/1928 | Suttle |
| 1,808,949 | A | 6/1931 | Flynn |

(Continued)

FOREIGN PATENT DOCUMENTS

| | | | |
|---|---|---|---|
| EP | 1418134 | A1 | 5/2004 |
| FR | 2942461 | A1 | 8/2010 |

(Continued)

OTHER PUBLICATIONS

ECO-Scoop—Light Objects—A Design Competition About Sustainability—printed Sep. 16, 2011—url: http://www.core77.com/lightobjects/brief.asp and http://www.core77.com/lightobjects/img/1344/default.asp referencing an exhibition starting in Oct. 17, 2006.

(Continued)

*Primary Examiner* — J. Gregory Pickett
*Assistant Examiner* — Niki M Eloshway
(74) *Attorney, Agent, or Firm* — Patent Law Offices Michael E. Woods; Michael E. Woods

(57) ABSTRACT

A system and method for co-packaging constructible utensil assemblies with a food container including a utensil layer and a protective laminate layer. The utensil is disposed in the assembly to be easily removed while concurrently being peeled from the protective laminate layer that helps to ensure the cleanliness and sanitary portions of portions of the utensil to contact the foodstuff.

7 Claims, 14 Drawing Sheets

(56) References Cited

U.S. PATENT DOCUMENTS

| | | | | |
|---|---|---|---|---|
| 1,851,942 | A | 3/1932 | Christie | |
| 1,907,737 | A | 5/1933 | Christie | |
| 2,375,266 | A | 5/1945 | Wilson | |
| 2,433,926 | A | 1/1948 | Sayre | |
| 2,453,393 | A | 11/1948 | Wilson | |
| 2,598,987 | A | 6/1952 | Franzen | |
| 2,728,516 | A | 12/1955 | Rodman | |
| 2,745,586 | A | 5/1956 | Thoma | |
| 3,334,778 | A * | 8/1967 | Saunders | 220/212 |
| 3,367,484 | A | 2/1968 | Nelson | |
| 3,380,307 | A * | 4/1968 | De Frank | 73/427 |
| 3,458,107 | A | 7/1969 | Lane et al. | |
| 3,487,974 | A | 1/1970 | Schovee | |
| 3,514,029 | A | 5/1970 | Powell | |
| 3,679,093 | A | 7/1972 | Chang | |
| 3,722,779 | A | 3/1973 | Chang | |
| 3,828,999 | A | 8/1974 | Humphrey | |
| 3,931,925 | A | 1/1976 | Ruff | |
| 3,955,742 | A * | 5/1976 | Marshall et al. | 220/574 |
| 3,961,566 | A | 6/1976 | Westphal et al. | |
| 4,036,398 | A | 7/1977 | Hoogvelt et al. | |
| 4,060,176 | A | 11/1977 | Tobiasson | |
| 4,201,795 | A | 5/1980 | Yamanaka | |
| 4,218,010 | A | 8/1980 | Ruff | |
| D257,406 | S * | 10/1980 | Ouellette | D30/162 |
| 4,251,097 | A * | 2/1981 | Whitten, II | 294/1.3 |
| 4,324,343 | A | 4/1982 | Moller | |
| 4,348,421 | A | 9/1982 | Sakakibara et al. | |
| 4,393,988 | A | 7/1983 | Burke | |
| D270,887 | S | 10/1983 | Allgeyer et al. | |
| 4,413,034 | A | 11/1983 | Anderson | |
| 4,635,843 | A | 1/1987 | Tomlinson | |
| D295,383 | S | 4/1988 | Anderson et al. | |
| 4,836,593 | A | 6/1989 | Cooley | |
| D309,210 | S | 7/1990 | Seyfert | |
| 4,940,189 | A | 7/1990 | Cremonese | |
| 4,962,849 | A | 10/1990 | Anderson | |
| 5,011,006 | A | 4/1991 | Anderson | |
| 5,065,923 | A * | 11/1991 | Hoefer | A47G 19/30 141/320 |
| 5,381,905 | A | 1/1995 | Mallmamm et al. | |
| 5,419,049 | A | 5/1995 | MacArthur-Onslow | |
| 5,695,084 | A | 12/1997 | Chmela et al. | |
| 5,705,212 | A * | 1/1998 | Atkinson | 426/115 |
| 5,797,636 | A | 8/1998 | Hamynen | |
| 5,878,461 | A | 3/1999 | Killian | |
| 5,884,953 | A | 3/1999 | Leighton et al. | |
| 5,992,667 | A | 11/1999 | Huang | |
| 6,247,735 | B1 | 6/2001 | Berkman | |
| 6,308,833 | B1 | 10/2001 | Oravez | |
| 6,371,324 | B1 | 4/2002 | Torniainen et al. | |
| 6,604,645 | B1 | 8/2003 | Vaupotic | |
| 6,604,646 | B2 | 8/2003 | Torniainen et al. | |
| 6,817,480 | B1 * | 11/2004 | Baldasio | 220/216 |
| D530,986 | S | 10/2006 | Lago-Arenas | |
| 7,275,652 | B2 | 10/2007 | Morris et al. | |
| D554,951 | S | 11/2007 | McGrath | |
| D571,162 | S * | 6/2008 | Fite et al. | D7/642 |
| 7,597,063 | B2 | 10/2009 | Hartzell | |
| 7,637,417 | B2 | 12/2009 | Fite, IV et al. | |
| D612,692 | S | 3/2010 | Menceles | |
| 7,823,743 | B2 | 11/2010 | McKahan et al. | |
| D646,529 | S | 10/2011 | Cross | |
| D651,480 | S | 1/2012 | Cross | |
| 8,201,862 | B2 * | 6/2012 | Langley | 294/1.3 |
| 8,210,381 | B2 | 7/2012 | Cross | |
| 8,313,001 | B1 | 11/2012 | Reid et al. | |
| 8,484,855 | B1 * | 7/2013 | King, Sr. | 30/324 |
| 8,695,828 | B2 | 4/2014 | Cross | |
| 2002/0060220 | A1 | 5/2002 | Torniainen et al. | |
| 2002/0114870 | A1 | 8/2002 | Rebhorn et al. | |
| 2005/0115974 | A1 * | 6/2005 | Micciulla | 220/574 |
| 2006/0289541 | A1 * | 12/2006 | Boback | B65D 43/0254 220/266 |
| 2007/0084064 | A1 | 4/2007 | Fite et al. | |
| 2007/0227919 | A1 | 10/2007 | True | |
| 2008/0072432 | A1 | 3/2008 | Teys et al. | |
| 2008/0093366 | A1 | 4/2008 | McKahan et al. | |
| 2008/0110885 | A1 | 5/2008 | Cross | |
| 2008/0245682 | A1 | 10/2008 | Foulke | |
| 2009/0294454 | A1 | 12/2009 | Harding | |
| 2010/0194128 | A1 | 8/2010 | Langley | |
| 2010/0218382 | A1 * | 9/2010 | Scott | 30/147 |
| 2011/0303678 | A1 | 12/2011 | Zomorodi et al. | |
| 2012/0052162 | A1 | 3/2012 | Goulart | |
| 2013/0097877 | A1 | 4/2013 | Cross | |
| 2014/0069933 | A1 | 3/2014 | Cross | |
| 2014/0103675 | A1 | 4/2014 | Cross | |

FOREIGN PATENT DOCUMENTS

| | | | |
|---|---|---|---|
| GB | 2249470 | A | 5/1992 |
| JP | 52012089 | U | 1/1977 |
| JP | 53068780 | U | 6/1978 |
| JP | 3032192 | U9 | 10/1996 |
| JP | 10019636 | A | 1/1998 |
| JP | 2000162016 | A | 6/2000 |
| JP | 2000166735 | A | 6/2000 |
| JP | 3281262 | B2 | 5/2002 |
| JP | 3374276 | B2 | 2/2003 |
| JP | 3636280 | B2 | 4/2005 |
| KR | 1020020026221 | A | 4/2002 |
| KR | 200382814 | Y1 | 4/2005 |
| WO | 2007048055 | A2 | 4/2007 |
| WO | 2008061080 | A2 | 5/2008 |
| WO | 2014042705 | A1 | 3/2014 |
| WO | 2014059369 | A1 | 4/2014 |

OTHER PUBLICATIONS

11559518—EcoScoop_Arran Smith.pdf, "Eco-Scoop Biodegradable Eating Utensil", Arran Smith, Corflot, 2004 Exhibition, pp. 1-5, http://www.coroflot.com/ags/Eco-Scoop/1, Retrieved Dec. 5, 2011.

Extended European Search Report—EPO Application—14794638.8—PCTUS2014037037—dated Feb. 8, 2017.

* cited by examiner

POP-OUT CONSTRUCTIBLE UTENSIL

CROSS REFERENCE TO RELATED APPLICATIONS

The application claims benefit of US Patent Application No. 61/820,667 and also claims benefit of US Patent Application No. 61/890,313. This application is related to U.S. patent application Ser. No. 13/797,446 filed 12 Mar. 2013, to U.S. patent application Ser. No. 14/214,988 which claims benefit of U.S. Provisional Application No. 61/794,613 filed 15 Mar. 2013, and to U.S. patent application Ser. No. 14/032,194 filed 19 September claiming benefit of US Provisional Application No. 61/712,610 filed 11 Oct. 2012. The contents of these applications are hereby expressly incorporated by reference thereto in their entireties for all purposes.

FIELD OF THE INVENTION

The present invention relates generally to utensils, and more specifically, but not exclusively, to constructible utensils including a temporary protective sanitary layer and/or those used in connection with a container.

BACKGROUND OF THE INVENTION

The subject matter discussed in the background section should not be assumed to be prior art merely as a result of its mention in the background section. Similarly, a problem mentioned in the background section or associated with the subject matter of the background section should not be assumed to have been previously recognized in the prior art. The subject matter in the background section merely represents different approaches, which in and of themselves may also be inventions.

One use for disposable utensils is inclusion with a foodstuff container to enable convenient consumption of the foodstuff. Disposable utensils include plastic spoons or forks that are co-packaged with the container. Providing suitable packaging that ensures availability and cleanliness of the utensil are chronic challenges for co-packaged disposable utensils.

When implemented as a commodity product for disposable consumption of foodstuff, price is a primary consideration (along with satisfaction of other goals of meeting various standards for waste (e.g., compostability) and consumer's other use and environmental concerns).

The annual market size of disposable utensils is in the billions of units, and any reduction in cost is significantly magnified by that volume. There is always a trade-off in cost reduction to maintain usability. For consumers, usability includes mouth feel and whether the constructed utensil is able to operate for the intended purpose. For example, certain types of foodstuff are better suited to one type of constructed utensil than another. Even when the class of constructed utensil is correct, the appropriateness of the constructed utensil is further gauged as to whether it may be predictably constructed into the desired utensil.

A particular type of container is a parfait cup. A current solution for a parfait cup includes three independent parts: a clear cold cup, a parfait insert, and a lid. The clear cold cup is generally a transparent cup that holds about 9 ounces and is partially filled with desired ingredients (for example fruit and yogurt). The parfait insert is a tray that holds dry ingredients to be mixed with the desired ingredients by the consumer. For example, it may include granola or the like to complement the ingredients in the clear cold cup. The parfait insert holds less volume (e.g., 2 ounces) and is designed to fit within a top opening of the clear cold cup and to be supported there so it is available to be removed by the consumer so the complementary ingredients may be poured into the clear cold cup and mixed. The parfait insert may have an upper rim that suspends the tray at the opening of the clear cold cup. The lid, independent from the other components, covers and seals the parfait cup by engaging the clear cold cup and simultaneously holding the parfait insert in place.

A disadvantage to this solution is that there is no easy way to provide the consumer with a utensil for ready enjoyment of the foodstuff. U.S. Pat. No. 8,210,381 to EcoTensil, Inc. describes various configurations of spoon lid solutions that may be used successfully to provide the consumer with a simple and convenient folding eating utensil. (U.S. Pat. No. 8,210,381 is hereby expressly incorporated by reference in its entirety for all purposes.) For example a spoon lid may be provided within the parfait insert prior to the lid being added and closing the clear cup opening.

For some manufacturers of packaging solutions, the existing solutions may not be an optimal solution as it introduces a fourth manufacturing step and/or component to the existing processes and components (the 3 conventional parfait elements and the added spoon lid/utensil).

There is also a class of container that includes a double-wall construction. This class of container is sometimes used for hot foods. An example of such a container is an oatmeal container in which the double wall construction is provided to aid in cooking and venting of steam (for example, the lid is manufactured with a double wall construction).

What is needed is a system and method for improving constructible utensil options to address the various deficiencies, particularly in certain circumstances and contexts including improving co-packaging of a disposable utensil with a foodstuff container and providing an on-package constructible utensil solution for a multi-part foodstuff container, such as a parfait container including an independent parfait tray.

BRIEF SUMMARY OF THE INVENTION

Disclosed is a system and method for improving constructible utensil options to address the various deficiencies, particularly in certain circumstances and contexts, including improving co-packaging of a disposable utensil with a foodstuff container and providing an on-package constructible utensil solution for a multi-part foodstuff container, such as a parfait container including an independent parfait tray.

The following summary of the invention is provided to facilitate an understanding of some of the technical features related to definition and use of constructible utensil assemblies that may be used in food co-packaging and the like, and is not intended to be a full description of the present invention. A full appreciation of the various aspects of the invention can be gained by taking the entire specification, claims, drawings, and abstract as a whole. The present invention is applicable to other containers, utensils, constructible structures, and uses in addition to food co-packaging.

Further, the following summary of the invention is provided to facilitate an understanding of some of technical features related to on-package utensil provisioning for multi-part containers, and is not intended to be a full description of the present invention. A full appreciation of the various aspects of the invention can be gained by taking the entire specification, claims, drawings, and abstract as a whole. The present invention is applicable to other container types in addition to parfait containers and is not limited to foodstuff containers or constructible eating utensils.

In a simple implementation of the present invention, an embodiment includes a main container defining a primary holding volume accessed through a top opening and a modified tray insert defining a secondary holding volume accessed through a second opening, the tray insert extending into the primary holding volume while simultaneously functioning as the closure system for the primary holding volume that closes, secures, and seals the top opening. A spoon lid is used to close, secure and seal the second opening. The spoon lid includes a constructible eating utensil that is available to the consumer to prepare (e.g., mix) and consume the foodstuff. This configuration has three elements that includes an on-package constructible utensil which for some may be an improvement over existing spoon lid solutions in that it includes the same number of elements achieving the same results, while offering an on-package utensil.

Any of the embodiments described herein may be used alone or together with one another in any combination. Inventions encompassed within this specification may also include embodiments that are only partially mentioned or alluded to or are not mentioned or alluded to at all in this brief summary or in the abstract. Although various embodiments of the invention may have been motivated by various deficiencies with the prior art, which may be discussed or alluded to in one or more places in the specification, the embodiments of the invention do not necessarily address any of these deficiencies. In other words, different embodiments of the invention may address different deficiencies that may be discussed in the specification. Some embodiments may only partially address some deficiencies or just one deficiency that may be discussed in the specification, and some embodiments may not address any of these deficiencies.

Other features, benefits, and advantages of the present invention will be apparent upon a review of the present disclosure, including the specification, drawings, and claims.

BRIEF DESCRIPTION OF THE DRAWINGS

The accompanying figures, in which like reference numerals refer to identical or functionally-similar elements throughout the separate views and which are incorporated in and form a part of the specification, further illustrate the present invention and, together with the detailed description of the invention, serve to explain the principles of the present invention.

FIG. 9 illustrates a first embodiment for a spoon lid;

FIG. 10 illustrates a second embodiment for a spoon lid;

FIG. 11 illustrates a first embodiment for an inset perimeter corresponding to the first embodiment of the spoon lid illustrated in FIG. 9;

FIG. 12 illustrates a second embodiment for an inset perimeter corresponding to the second embodiment of the spoon lid illustrated in FIG. 10;

DETAILED DESCRIPTION OF THE INVENTION

Figure 1:
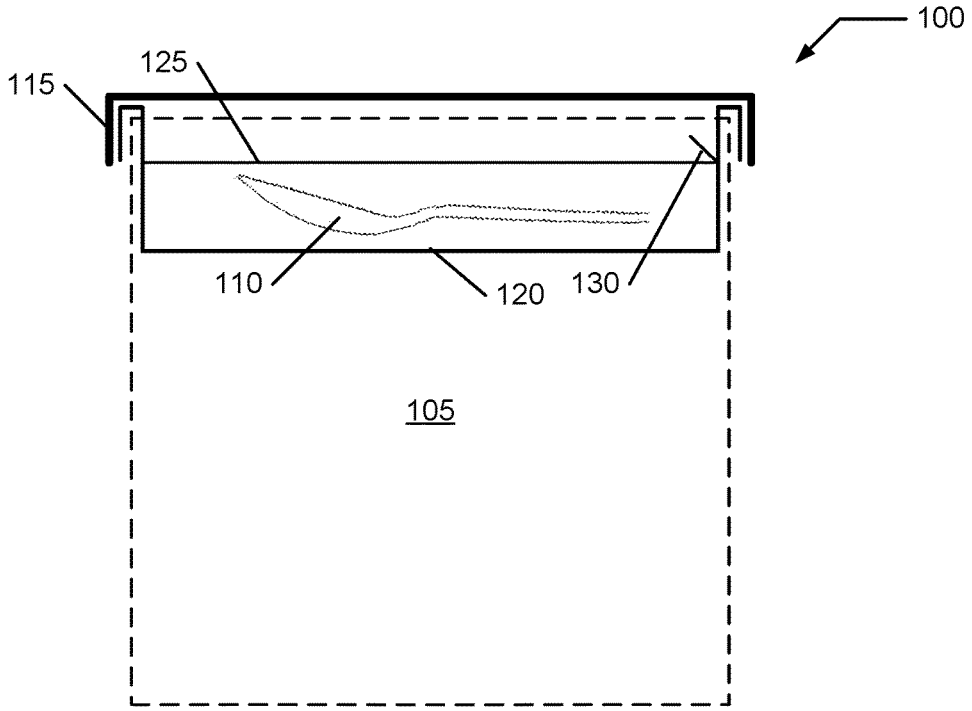
FIG. 1 (prior art)
FIG. 1 illustrates a side view of a foodstuff container including a co-packaging of a conventional disposable utensil as part of an opening covering.

Embodiments of the present invention provide a system and method for improving constructible utensil options to address the various deficiencies, particularly in certain circumstances and contexts, including improving co-packaging of a disposable utensil with a foodstuff container and providing an on-package constructible utensil solution for a multi-part foodstuff container, such as a parfait container including an independent parfait tray. The following description is presented to enable one of ordinary skill in the art to make and use the invention and is provided in the context of a patent application and its requirements.

Various modifications to the preferred embodiment and the generic principles and features described herein will be readily apparent to those skilled in the art. Thus, the present invention is not intended to be limited to the embodiment shown but is to be accorded the widest scope consistent with the principles and features described herein.

Definitions

The following definitions apply to some of the aspects described with respect to some embodiments of the invention. These definitions may likewise be expanded upon herein.

As used herein, the singular terms "a," "an," and "the" include plural referents unless the context clearly dictates otherwise. Thus, for example, reference to an object can include multiple objects unless the context clearly dictates otherwise.

Also, as used in the description herein and throughout the claims that follow, the meaning of "in" includes "in" and "on" unless the context clearly dictates otherwise.

As used herein, the term "set" refers to a collection of one or more objects. Thus, for example, a set of objects can include a single object or multiple objects. Objects of a set also can be referred to as members of the set. Objects of a set can be the same or different. In some instances, objects of a set can share one or more common properties.

As used herein, the term "adjacent" refers to being near or adjoining. Adjacent objects can be spaced apart from one another or can be in actual or direct contact with one another. In some instances, adjacent objects can be coupled to one another or can be formed integrally with one another.

As used herein, the terms "couple," "coupled," and "coupling" refer to an operational connection or linking. Coupled objects can be directly connected to one another or can be indirectly connected to one another, such as via an intermediary set of objects.

As used herein, the terms "about," "substantially," and "substantial" refer to a considerable degree or extent. When used in conjunction with an event or circumstance, the terms can refer to instances in which the event or circumstance occurs precisely as well as instances in which the event or circumstance occurs to a close approximation, such as accounting for typical tolerance levels or variability of the embodiments described herein. Absent specific values for typical tolerance levels or variability, the terms mean plus or minus 10 percent of the indicated value.

As used herein, the terms "optional" and "optionally" mean that the subsequently described event or circumstance may or may not occur and that the description includes instances where the event or circumstance occurs and instances in which it does not.

As used herein, the term "size" refers to a characteristic dimension of an object. Thus, for example, a size of an object that is spherical can refer to a diameter of the object. In the case of an object that is non-spherical, a size of the non-spherical object can refer to a diameter of a corresponding spherical object, where the corresponding spherical object exhibits or has a particular set of derivable or measurable properties that are substantially the same as those of the non-spherical object. Thus, for example, a size of a non-spherical object can refer to a diameter of a corresponding spherical object that exhibits light scattering or other properties that are substantially the same as those of the non-spherical object. Alternatively, or in conjunction, a size of a non-spherical object can refer to an average of various orthogonal dimensions of the object. Thus, for example, a size of an object that is a spheroidal can refer to an average of a major axis and a minor axis of the object. When referring to a set of objects as having a particular size, it is contemplated that the objects can have a distribution of sizes around the particular size. Thus, as used herein, a size of a set of objects can refer to a typical size of a distribution of sizes, such as an average size, a median size, or a peak size.

Discussed herein are application and arrangement of a bowl-forming scoring pattern on a planar blank removably defined in a constructible utensil assembly that produces a bowl in a constructible utensil when an unconstructed and undistorted blank is constructed/distorted along a fold line/axis (the scoring pattern is typically symmetric about this fold axis), the distortion propagating along scores of the scoring pattern. For purposes of this patent application, the bowl-forming scoring pattern includes the set of scores that produce a shaped and contoured curvilinear three-dimensional bowl when the blank is folded. The bowl-forming scoring pattern includes, when present, scores that define a fold axis as well as those that propagate any folding/distortion that create the bowl.

Figure 2:
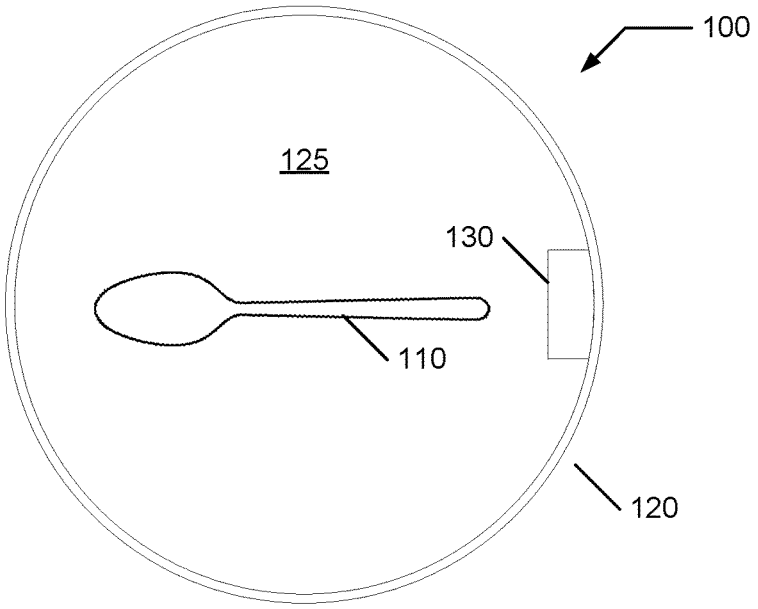
FIG. 2 (prior art)
FIG. 2 illustrates a top view of the foodstuff container of FIG. 1.

FIG. 1 illustrates a side view of a foodstuff delivery system 100 including a foodstuff container 105 having a co-packaging of a conventional disposable utensil 110 as part of an opening covering and FIG. 2 illustrates a top view of foodstuff delivery system 100 without a lid.

Container 105 has base (e.g., circular, rectilinear (square), or other regular or irregular shape) with substantially vertically extending sidewalls that define an opening. A lid 115 covers and secures the opening. In some instances a rigid cavity-defining structure 120 is placed in the opening that is made from paperboard, plastic or the like to form a storage location for utensil 110. To help ensure that utensil 110 is not prematurely removed and to help promote cleanliness of utensil 110, one or more coverings 125 overlies utensil 110 (e.g., there is a cover and may be a second plastic overwrap). A pull-tab 130 aids the user in removing the covering 125 to reveal the storage location allowing access and removal of utensil 110. When the user desires to access the foodstuff with utensil 110, structure 120 is removed or perforated. In FIG. 2, lid 115 is removed and utensil 110 is disposed below covering 125 within the storage location of structure 120. Some delivery systems 100 may not have an independent structure 120 (e.g., it may be integrated into one or more other components) defining the storage location but they typically support covering 125 overlying a storage location holding utensil 110.

One of the drawbacks of system 100 is that there are extra costs to the manufacturer and the user. The manufacturer makes the volume of container 105 great enough to support the extra volume of structure 120 (or its equivalent) necessary for the typically solution that uses a preformed three-dimensional utensil having a pre-built bowl. There are attendant extra costs associated with this solution when other less volume-intensive solutions are available for use. While the costs individually may be relatively small, they accumulate over tens, hundreds, thousands, millions, and more of delivery systems. The user is inconvenienced by using a plastic spoon that is not a green environmentally efficient solution and having a relatively complicated solution for accessing utensil 110.

Figure 3:
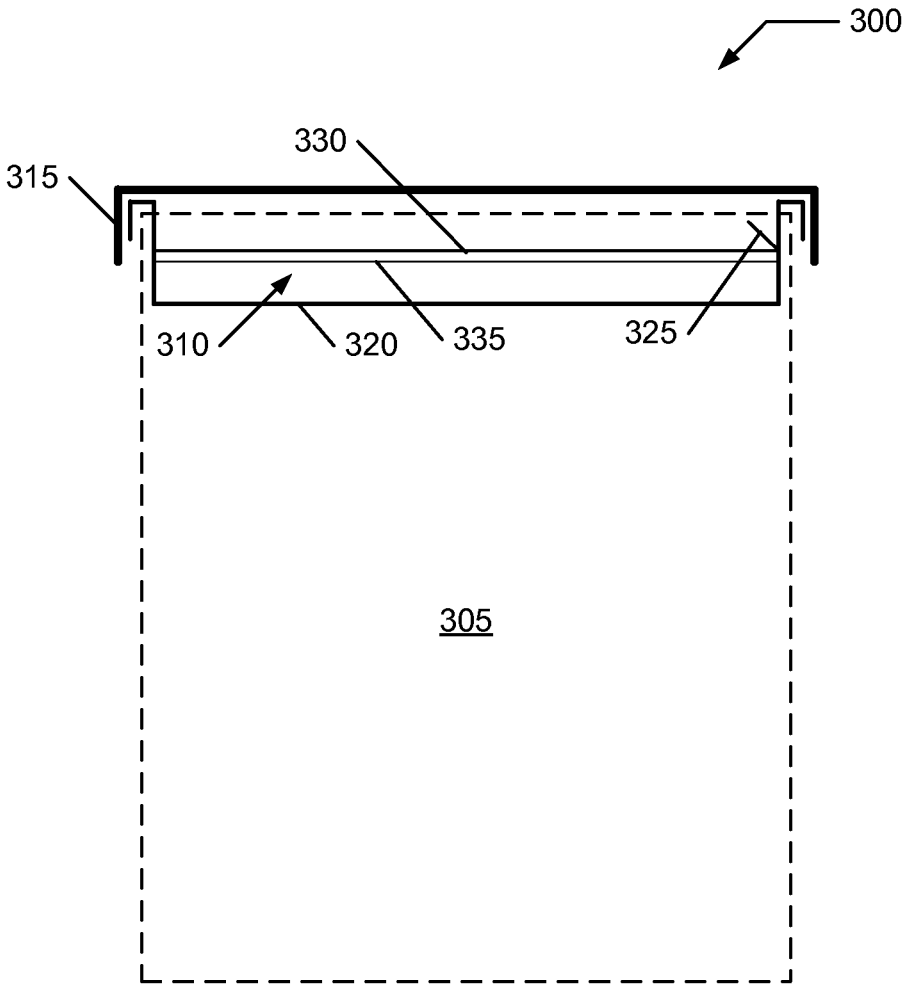
FIG. 3 illustrates a side view of an improved co-packaging of a foodstuff container a with a constructible utensil assembly.

FIG. 3 illustrates a side view of a foodstuff delivery system 300 including an improved co-packaging of a foodstuff container 305 and a disposable constructible utensil assembly 310.

Container 305 has base (e.g., circular, rectilinear (square), or other regular or irregular shape) with substantially vertically extending sidewalls that define an opening. A lid 315 covers and secures the opening. In some instances a rigid cavity-defining structure 320 is placed in the opening that is made from paperboard, plastic or the like to form a storage location for assembly 310. However because of the unique design, structure 320 is optional as assembly 310 is more readily integrated into other structures (and when present, it may be made much shallower than suggested by FIG. 3 (a thickness of a blank such as about 10-20 point caliper). A pull-tab 325 aids the user in accessing all or part of assembly 310 (all of assembly 310 may be removed or just a constructible utensil that is provided as part of assembly 310 may be removed). Some delivery systems 300 may not have an independent structure 320 (e.g., it may be integrated into one or more other components) defining the storage location.

Constructible utensil assembly 310 includes a planar utensil layer 330 and an optional protective layer 335 that may be disposed on top of or underneath utensil layer 330 (FIG. 3 illustrates protective layer 335 underneath utensil layer 33). A portion of utensil layer 330 defines a constructible utensil that includes a foodstuff contacting portion that is sealed and protected by protective layer 335 (when present). The user is able to detach the constructible utensil from utensil layer 330 and concurrently peel the constructible utensil away from protective layer 335.

Preferably protective layer 335 is a thin flexible impermeable layer that is adhered with semi-tacky adhesive or other attachment system to provide a sanitary barrier to the foodstuff contacting portion(s) of the constructible utensil defined in and by utensil layer 330.

As is appreciated from a comparison of FIG. 3 with FIG. 1, and as explained herein, the material requirements and extra volume displacement requirements are less with use of a constructible utensil assembly 310.

Figure 4:
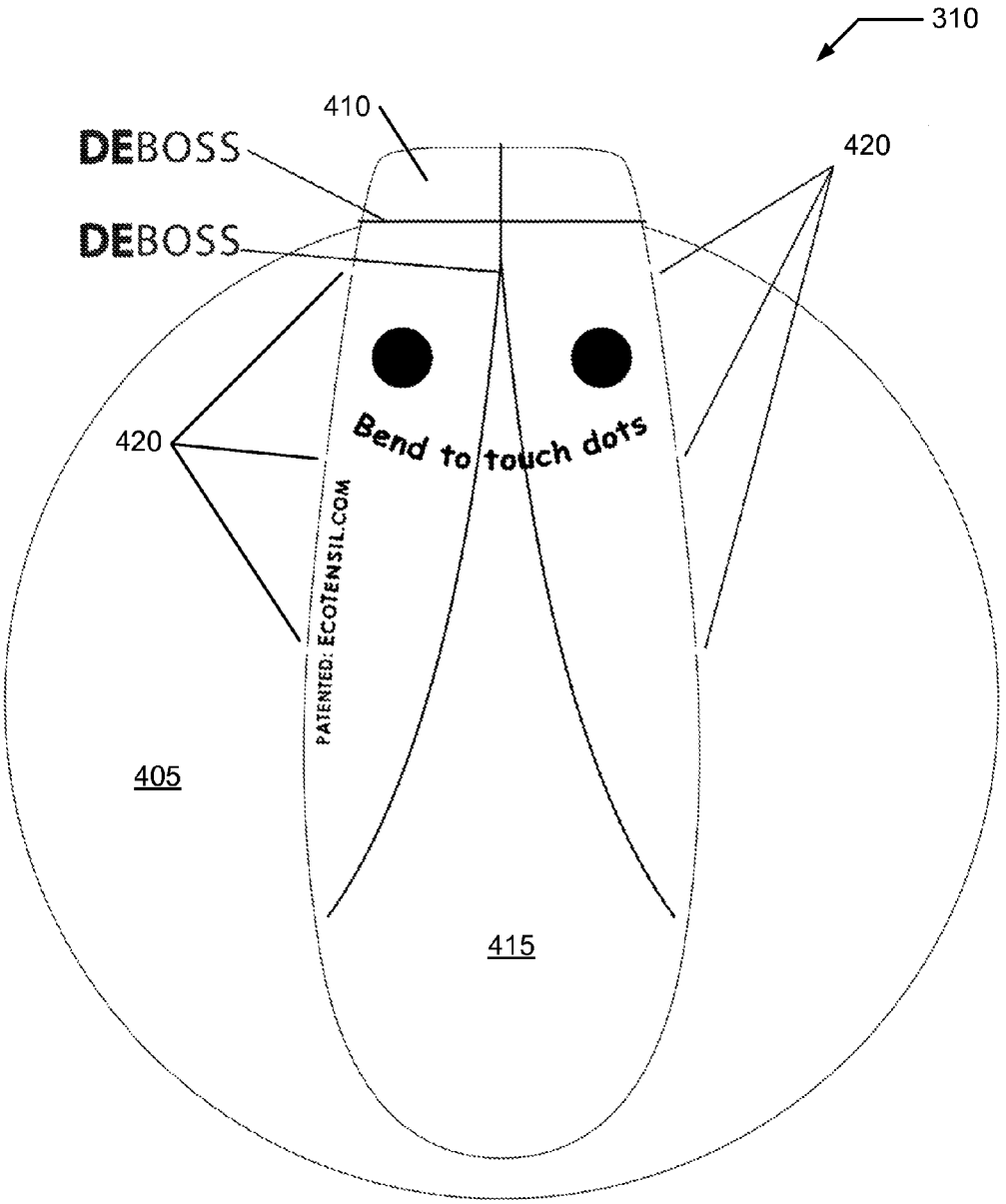
FIG. 4 illustrates a top view of a first embodiment for the constructible utensil assembly of FIG. 3.

FIG. 4 illustrates a top view of a first embodiment for constructible utensil assembly 310 of FIG. 3. First embodiment for constructible utensil assembly 310 includes a blank 405 having an outer periphery complementary to, and in some cases closely matching, an inner perimeter of the opening of container 305, which may be circular, square/rectilinear, elliptical, or other shape to allow assembly 310 to wholly or partially function as a closure for the opening. Included at an exterior portion of the perimeter is an optional tab 410 that is connected to a constructible utensil 415 defined in blank 405. Constructible utensil 415 has an outer perimeter defined within blank 405 that extends from one portion of the outer periphery to another portion of the outer periphery. Thus the peripheries of blank 405 and utensil 415 are relatively independent (as noted utensil 415 is disposed within blank 405 and thus may not be larger).

Not shown in FIG. 4 is optional protective layer 335 that provides a thin underlying laminate film (e.g., polymer, elastomer, or the like) which at least covers the underneath side of constructible utensil 415 and may extend under all of blank 405. Protective layer 335 is releasably coupled to utensil 415 (e.g., such as by a semi-tacky adhesive applied to its underside or secure attachment of protective layer 335 to blank 405 so protective layer 335 spans the expanse of utensil 415, or other releasable coupling).

Utensil 415 is secured in assembly 310 in any of several different ways, including use of "nicks" 420 which are small discontinuities in the perimeter-defining cut that defines utensil 415 in blank 405. Nicks 420 are easily torn or detachable providing a releasable coupling mechanism. Another option includes use of the semi-tacky adhesive or coupling system that retains utensil 415 to protective layer 335 in addition to or in lieu of the nicks 420.

The present invention may be implemented using virtually any scoring pattern appropriate to form the desired constructed utensil (e.g., for foodstuff, measuring cup, or the like). Some of these utensils and some scoring patterns are set forth and described in the incorporated patent applications; it being understood that additional patterns are possible. In the implementation illustrated in FIG. 4, the scoring pattern is produced by a debossing process that produces the scores that can propagate a folding of utensil 415 to produce the desired three-dimensional bowl, for example. In utensil 415, a lateral score near a back of a handle portion (e.g., an edge portion) defines a bend for tab 410 to allow it to bend upwardly toward an opening of the container when installed to allow the user to grip and extract all or a portion of assembly 415. As illustrated, in some implementations tab 410 allows utensil to be concurrently detached from the remainder of blank 405 and peeled away from protective layer 335. In other implementations, as described further below, a slot at the edge portion for a thumb or other digit (sometimes referred to as a thumb-hole) that extends inside a circumference (or perimeter for non-circular blanks) of blank 405 is an alternative to removal of utensil 415 from blank 405.

Figure 5:
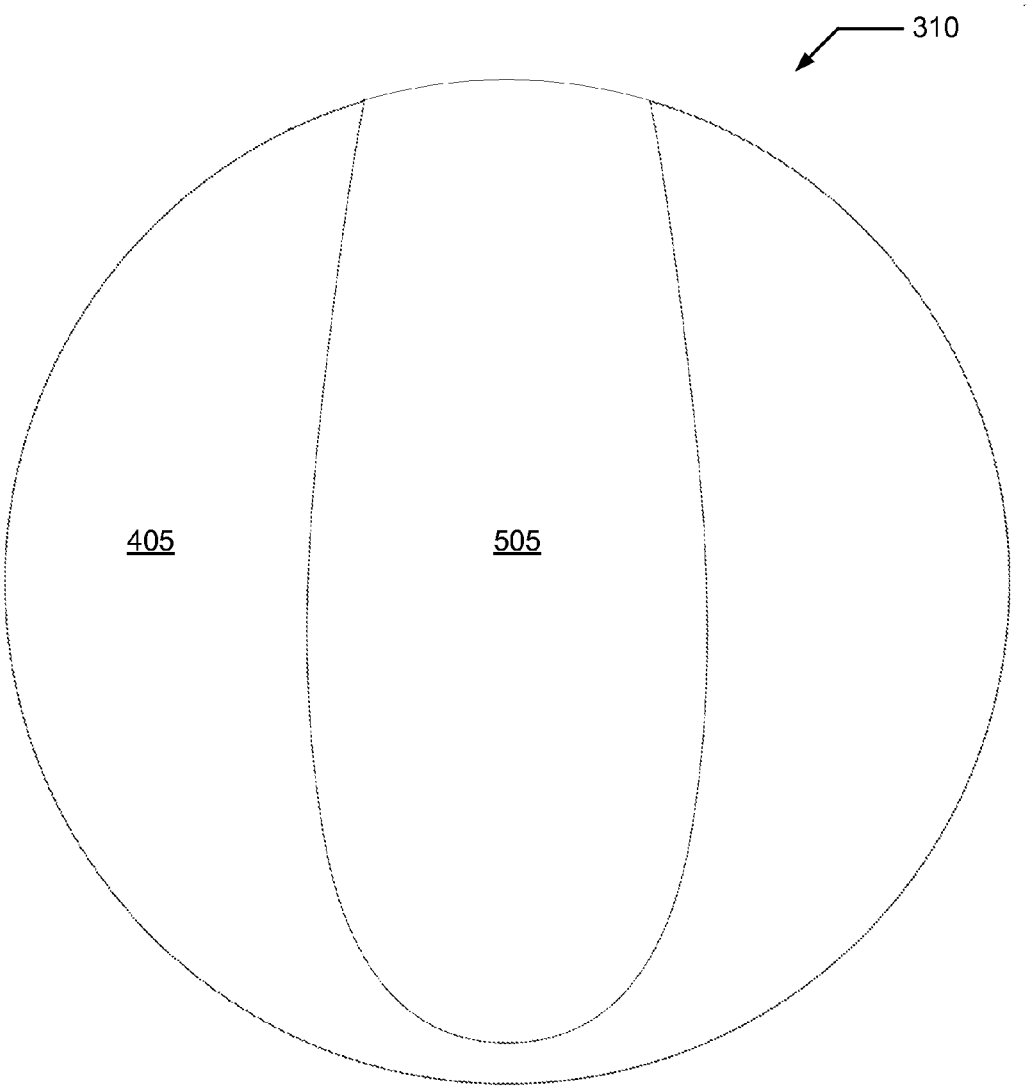
FIG. 5 illustrate a top view of the first embodiment for the constructible utensil assembly of FIG. 4 with the constructible utensil peeled away.

FIG. 5 illustrate a top view of the first embodiment for the constructible utensil assembly 310 of FIG. 4 with constructible utensil 415 peeled away to reveal a portion 505 of protective layer 335.

Figure 6:
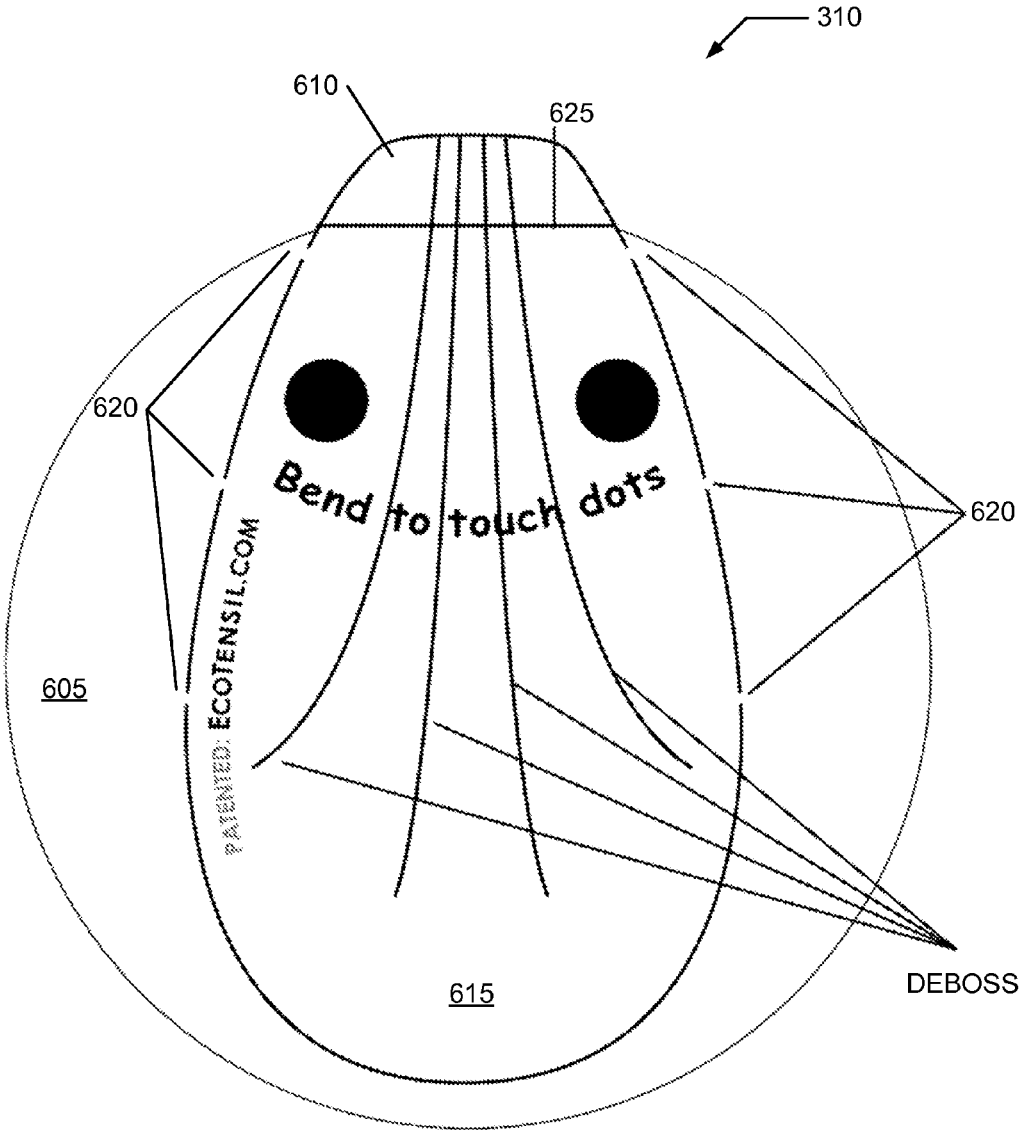
FIG. 6 illustrates a top view of a second embodiment for the disposable constructible utensil of FIG. 3.

FIG. 6 illustrates a top view of a second embodiment for constructible utensil assembly 310 of FIG. 3 similar in construction and operation as the first embodiment of FIG. 4 except for details of the constructible utensil. Second embodiment for constructible utensil assembly 310 includes a blank 605 having an outer periphery complementary to, and in some cases closely matching, an inner perimeter of the opening of container 305, which may be circular, square/rectangular/rectilinear, elliptical, or other regular or irregular polygon having N number of sides, N=3 to 10, shape to allow assembly 310 to wholly or partially function as a closure for the opening. Included at an exterior portion of the perimeter is an optional tab 610 that is connected to a constructible utensil 615 defined in blank 605. Constructible utensil 615 has an outer perimeter defined within blank 605 that extends from one portion of the outer periphery to another portion of the outer periphery.

Not shown in FIG. 6 is optional protective layer 335 that provides a thin underlying laminate film (e.g., polymer, elastomer, or the like) which at least covers the underneath side of constructible utensil 615 and may extend under all of blank 605. Protective layer 335 is releasably coupled to utensil 615 (e.g., such as by a semi-tacky adhesive applied to its underside or secure attachment of protective layer 335 to blank 605 so protective layer 335 spans the expanse of utensil 615, or other releasable coupling).

Utensil 615 is secured in assembly 310 in any of several different ways, including use of "nicks" 620 which are small discontinuities in the perimeter-defining cut that defines utensil 615 in blank 605. Nicks 620 are easily torn or detachable to provide one example of a releasable coupling mechanism. Another option includes use of the semi-tacky adhesive or coupling system that retains utensil 615 to protective layer 335 in addition to or in lieu of the nicks 620.

The present invention may be implemented using virtually any scoring pattern appropriate to form the desired constructed utensil. Some of these utensils and some scoring patterns are set forth and described in the incorporated patent applications; it being understood that additional patterns are possible. In the implementation illustrated in FIG. 6, the scoring pattern is produced by a debossing process that produces the scores that can propagate a folding of utensil 615 to produce the desired three-dimensional bowl, for example. In utensil 615, a lateral score 625 (or a thumb-hole as described herein) near a back of a handle portion (an edge portion) defines a bend for tab 610 to allow it to bend upwardly toward an opening of the container when installed to allow the user to grip and extract all or a portion of assembly 615. As illustrated, in some implementations tab 610 allows utensil to be concurrently detached from the remainder of blank 605 and peeled away from protective layer 335. Removal of utensil 615 from second embodiment of assembly 310 would reveal of portion of protective layer 335 similar to FIG. 5 except providing a window shape conforming to utensil 615 instead of utensil 415.

The disclosed constructible utensils are generally representative of a wide range of constructible utensils, some of which have been illustrated and described in related patents and patent applications. These related patents and patent applications include U.S. Pat. No. 8,210,381, D646,529, and D651,480, and U.S. patent application Ser. Nos. 13/357,557, 61/699,808, 61/699,787, 61/712,610, 13/797,446, and 61/794,880, all of which are hereby expressly incorporated by reference thereto in their entireties for all purposes. Other utensil shapes are possible in addition to those described, such as utensils including lateral handle/bowl free edges that straight and roughly parallel, to wasp-waisted (narrower at an intermediate portion) or bulging (wider at an intermediate portion) contours, as well as widened handles and or bowls.

The utensils include a deformable sheet that defines a handle and an operational element in which one or more scores, both straight and curved, are cooperatively provided on the sheet. The one or more scores enable deformation of the handle and/or the operational element(s) to convert the utensil into a strong, sturdy, and functional implement sufficient to meet the required application. The utensils may include a generally "bullet" shaped perimeter having a longitudinal folding axis about which the utensil is generally symmetric. Such a perimeter may be formed from a shape that is about 1.25 inches wide and about 3.125 inches long (the "bullet" shaped perimeter including a generally rectangular body that is about 1.25 inches×about 2.5625 inches and a semi-disk at one end of the rectangle having a radius of about 0.5625 inches). Preferably the stock material of the preferred embodiments have a thickness ranging between about 14-18 point caliper, though other thicknesses may be appropriate, depending upon design considerations. Scores and any desired indicia may be added before, during, or after formation. Preferably any ink for the indicia are non-toxic vegetable-based dyes. Some of the embodiments benefit from a coating to improve mouth-feel and/or provide a moisture-barrier to extend use for constructible utensils, such as those expected to be used for minutes instead of seconds. As noted, other sizes, configurations, and arrangements for utensil 100 are within the scope of the present invention.

In one embodiment, the unconstructed utensil is provided on a planar sheet made of the requisite material (i.e., an appropriately green/sustainable material) that may be processed to enhance function (e.g., coated with environmentally appropriate material) to resist premature degradation during use (e.g., a moisture-barrier) or it may be manufactured of a moisture-barrier material (e.g., calcium carbonate), collectively a coating, or inherent characteristic or other moisture protection system is referred to as moisture-barrier property. Thus, quantities of the unconstructed material achieve a far greater packing density as compared to pre-constructed utensils, which saves money on shipping and storage because of the smaller cube size. For many applications, the handle and operational elements are minimalist in material cost while maximizing structural strength and user-experience consistent with the intended use all the while having a smaller carbon footprint.

The handle, typically with one or more curved scores that define a folding axis, is operated by bringing lateral portions closer together out of the plane (e.g., folding or otherwise deforming) the handle along the one or more curved scores. This folding induces a responsive distortion/deformation of the operational element to create the desired functional element. The curved score(s), in cooperation with the structural organization and composition, produce a constructed utensil that meets or exceeds performance of conventional preformed disposable/single-use utensils. This provides a superior option over conventional constructed utensils because the user gains the advantage of an improved single-use application while the utensil is eco-friendly as it has a minimalist design that is effective and capable of being made compostable and/or recyclable with recyclable, sustainable, renewable resources. These constructible utensils may be particularly configured for specific applications, including tasting, stirring, spreading, consuming harder/firmer foodstuffs, "fork-like" utensil, and the like.

Manufacturers have an option of configuring the base material, the periphery boundary, the placement and orientation of scores, and any coating to customize the final design in a wide variety of ways. As further explained herein, the user-constructible utensils include tasters, spreaders, stirrers that can have appropriately shaped handles and operational elements (e.g., bowls for a tasting spoon) that have the desired capacity, shape, and mouth-feel. Some bowls may have a deep configuration for more capacity while others may be shallower and sturdier to serve dense/hard foodstuff (e.g., ice cream). The fundamental teachings herein are adaptable to a wide-variety of user-constructible utensils for a wide-variety of tasks. In some cases, the utensil doubles as a dispensing mechanism, in lieu of a cup, which is particularly important for applications that use a utensil along with a cup and/or plate/napkin, cracker, or the like, providing valuable cost-savings.

The utensil assemblies may be produced by a rotary printing process. A die-cut system may produces a matrix defining a set of constructible utensils assemblies each cycle. In a rotary die-cutting process, a roll of appropriate foundation material (e.g., paperstock) of the appropriate width and thickness is fed into a rotary press as a web. That rotary press uses a rotary die to print, score, and cut the web as desired. The rotary die includes a number of steel rules that define each utensil assembly and utensil by embossing the scores and cutting the perimeter.

The particular constructible utensils illustrated in FIG. 4 and FIG. 6 are simply illustrative implementations and other perimeter shapes and score patterns may be used as part of the disclosed constructible utensil assembly, some of which are disclosed or suggested in the incorporated patent applications.

Figure 7:
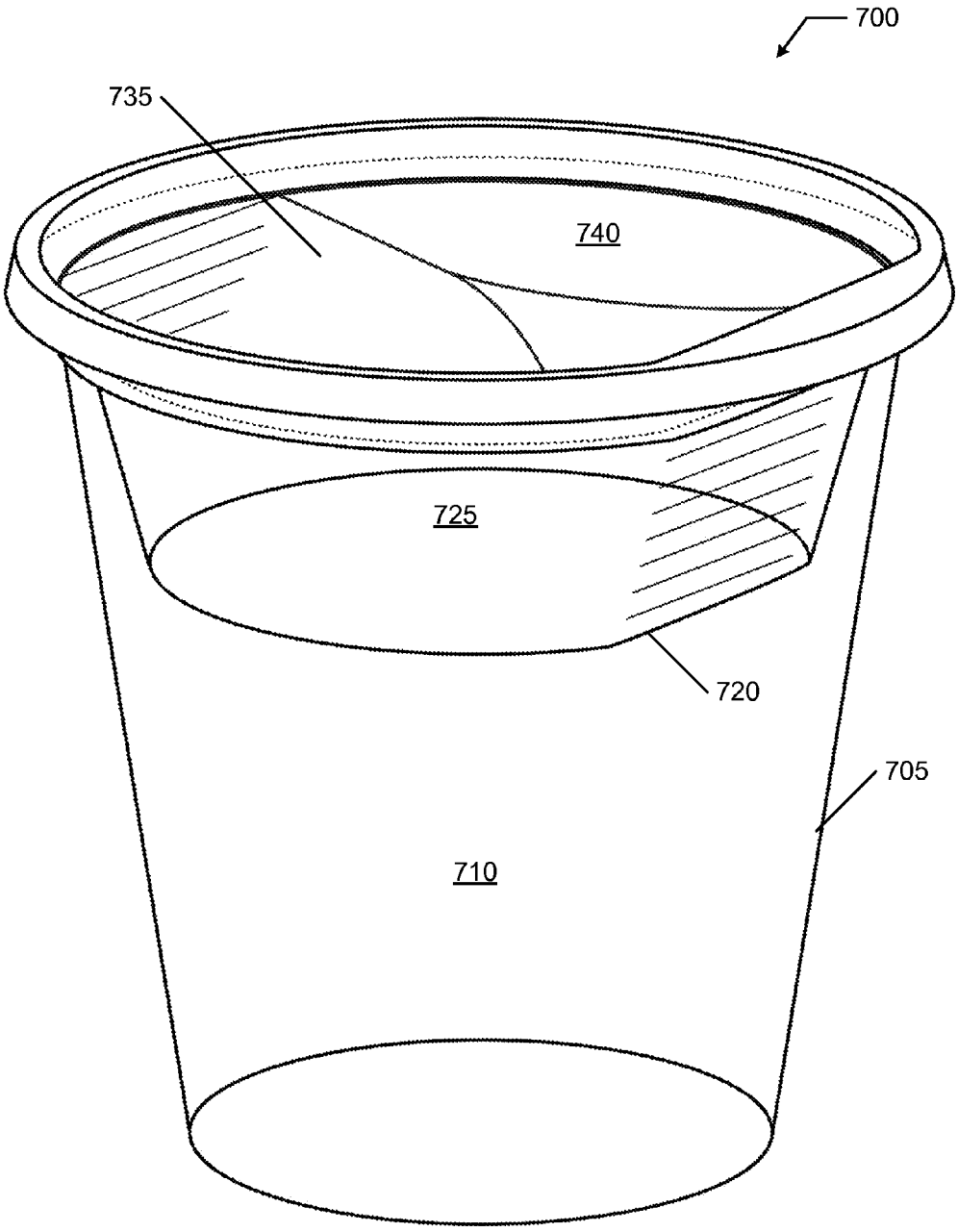
FIG. 7 illustrates a perspective view of an improved three-part parfait container.
Figure 8:
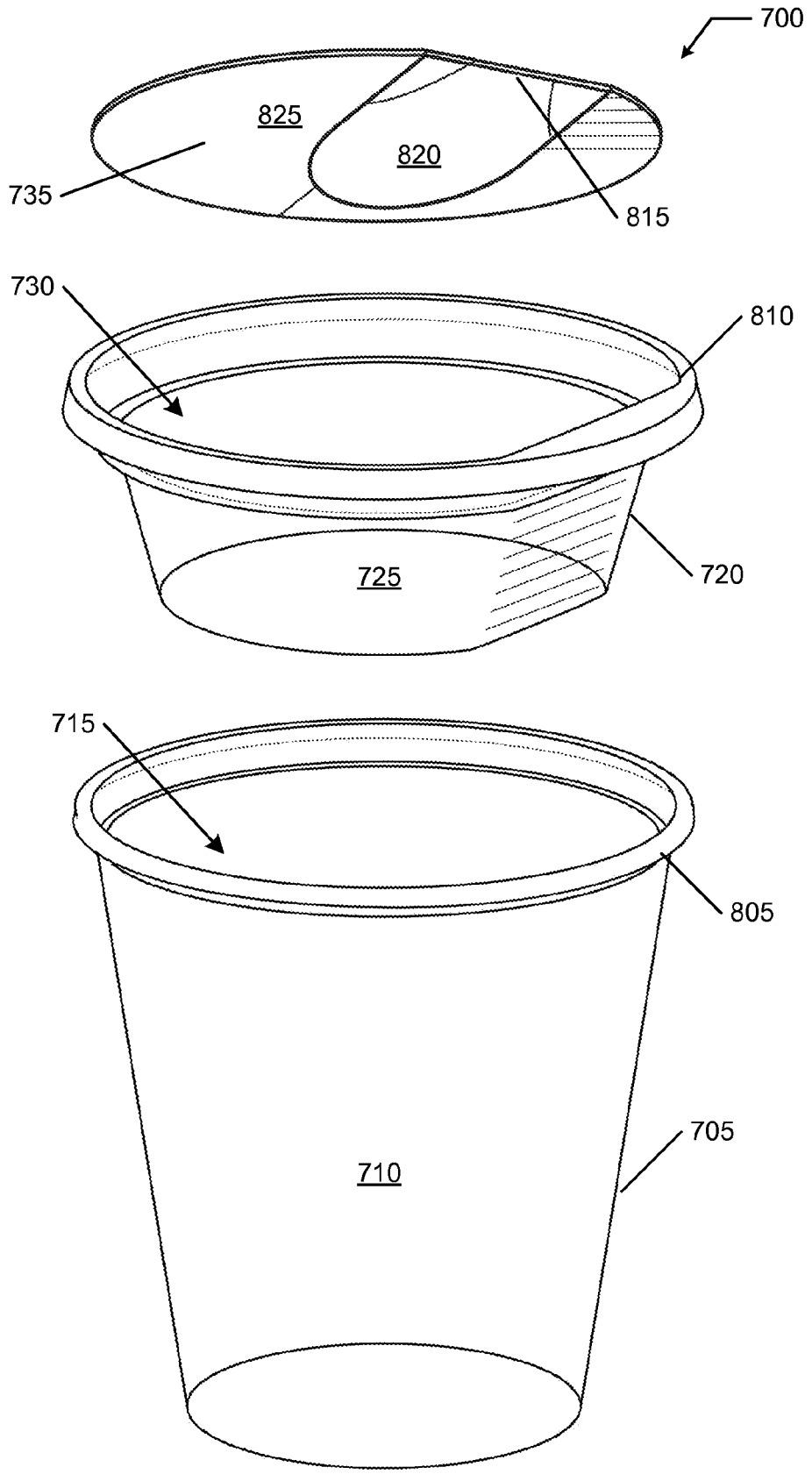
FIG. 8 illustrates an exploded view of the improved three-part parfait container of FIG. 7.

FIG. 7 illustrates a perspective view of an improved three-part parfait container 700 and FIG. 8 illustrates an exploded view of improved three-part parfait container 700. Three-part parfait container 700 includes a main container 705 defining a primary holding volume 710 accessed through a top opening 715 and a modified tray insert 720 defining a secondary holding volume 725 accessed through a second opening 730, tray insert 720 extending into primary holding volume 710 while simultaneously functioning as a primary closure system for primary holding volume 710 that closes, secures, and seals top opening 715. A spoon lid 735 is used as a secondary closure system to close, secure and seal second opening 730. Spoon lid 735 includes a constructible eating utensil that is available to the consumer to prepare (e.g., mix) and consume the foodstuff. This configuration uses three elements to achieve the functions of the prior art solution while also including an on-package constructible utensil which in some contexts is an improvement over existing solutions employing supplemental spoon lid solutions.

As illustrated in FIG. 8, main container 705 includes a first rim perimeter 805 around top opening 715 that serves as a first part of the primary closure system. Tray insert 720 includes a second rim perimeter 810 around second opening 730 that serves as a second part, complementary to the first part, of the primary closure system. Second rim perimeter 810 engages and locks to first rim perimeter 805 to close and seal top opening 815. There are many different primary closure systems that may be used to hold contents into primary holding volume 710 and secure tray insert 720 to main container 705. Tray insert 720 functions as both a lid and a secondary holding volume for three-part parfait container 700.

Spoon lid 735 includes a constructible utensil that has a perimeter sized and implemented to securely close and seal second opening 730. Second opening 730 may have virtually any opening perimeter shape, generally circular, rectilinear, oval, or the like, and spoon lid 735 will have a complementary perimeter to match. As illustrated, spoon lid 735 includes at least one lateral fold score 815 wherein a bowl portion 820 hingedly folds back 180 degrees against a handle portion 825 to provide a shortened length. A plurality of other score patterns, such as described in the incorporated patent applications, enable deformation of handle portion 825 to propagate into a three-dimensional bowl-producing deformation of bowl portion 820.

In the preferred embodiment, bowl portion 820 folds under handle portion 825 so it is within second holding volume 725 when spoon lid 735 closes and secures second opening 730. In this way bowl portion 820 may be sanitary and not require additional safety wrapping. In FIG. 7, a top surface 740 of spoon lid 735 may be provided with a pull tab (not shown) to allow spoon lid 735 to be opened and removed from second opening 730. In the embodiment illustrated in FIG. 7-FIG. 10, folding bowl portion 820 against handle portion 825 along fold score 815 provides folded spoon lid 735 having a flat chord segment. Second opening 730 is provided with complementary shape accommodating this flat chord segment and the entire perimeter.

Figure 9:
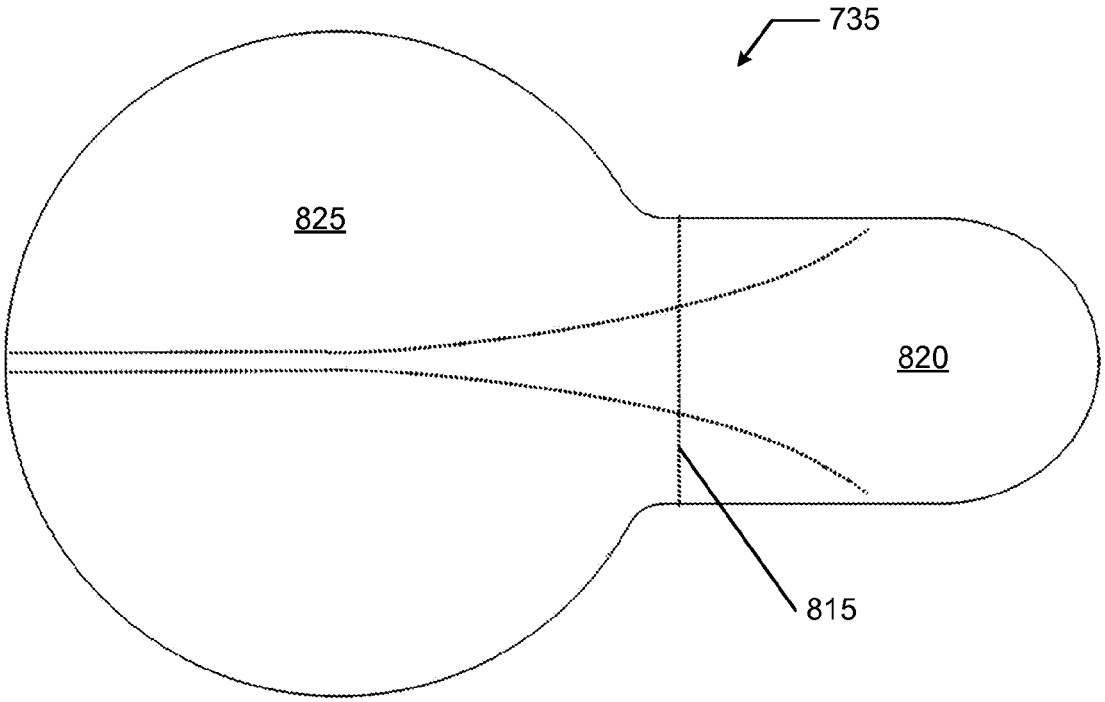
FIG. 9-FIG. 10 illustrate representative options, among other non-illustrated options, for a spoon lid for use in the improved parfait container illustrated in FIG. 7-FIG. 8.
Figure 10:
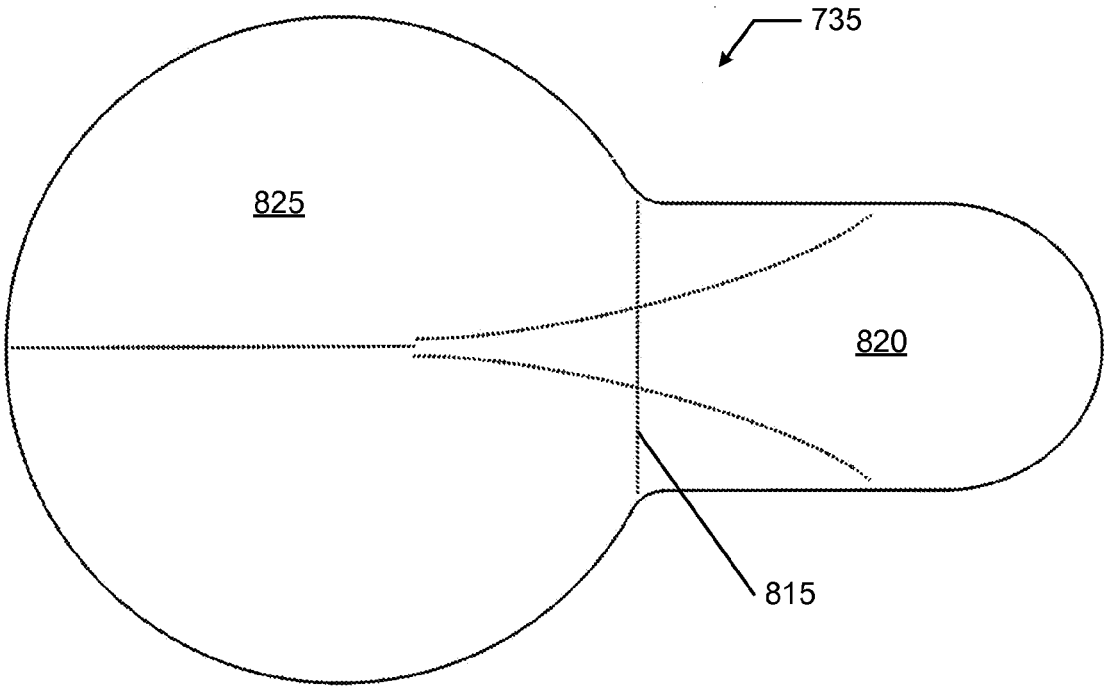

FIG. 9-FIG. 10 illustrate representative options, among other non-illustrated options, for an unfolded spoon lid for use as a constructible utensil in the improved parfait container illustrated in FIG. 7-FIG. 8. These are simply representative constructible utensils as many other different configurations may be used for spoon lid 735 to simultaneously close second opening 730 and function as a utensil for use in cooperation with container 700, even when container 700 is used for something other than a parfait implementation.

FIG. 9 illustrates a first embodiment for spoon lid 735; and FIG. 10 illustrates a second embodiment for spoon lid 735. The particular embodiments of FIG. 9 and FIG. 10 are described in detail in U.S. patent application Ser. No. 13/797,446, hereby expressly incorporated by reference in its entirety for all purposes. In addition, there are other applications detailing features and options for spoon lid 735, including U.S. patent application Ser. No. 13/357,557 filed 24 Jan. 2012, U.S. patent application 61/820,667 filed 7 May 2013, US patent application 61/712,610 filed 11 Oct. 2012, and International patent application PCT/US13/64689 filed 11 Oct. 2013, all of which are hereby expressly incorporated by reference in their entireties for all purposes. Spoon lid 135 may include measure scoop characteristics, some of which are detailed in one or more of the incorporated patent applications.

Top surface 740 may optionally be used for printing marketing and/or informational content that is sometimes applied to a top sticker or overwrap (that is no longer required with this implementation). Top surface 740 may be beautifully printed and offer this further advantage when the conventional top sticker is not required or otherwise desired.

Figure 11:
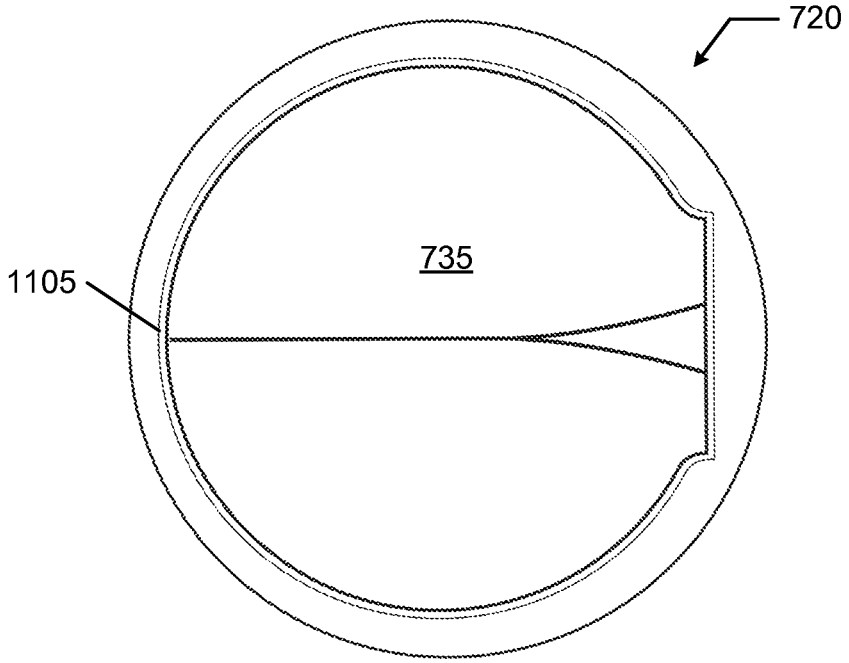
FIG. 11-FIG. 12 illustrate representative options, among other non-illustrated options, for an inset perimeter of the tray insert corresponding to the spoon lid options illustrated in FIG. 9 and FIG. 10, respectively.
Figure 12:
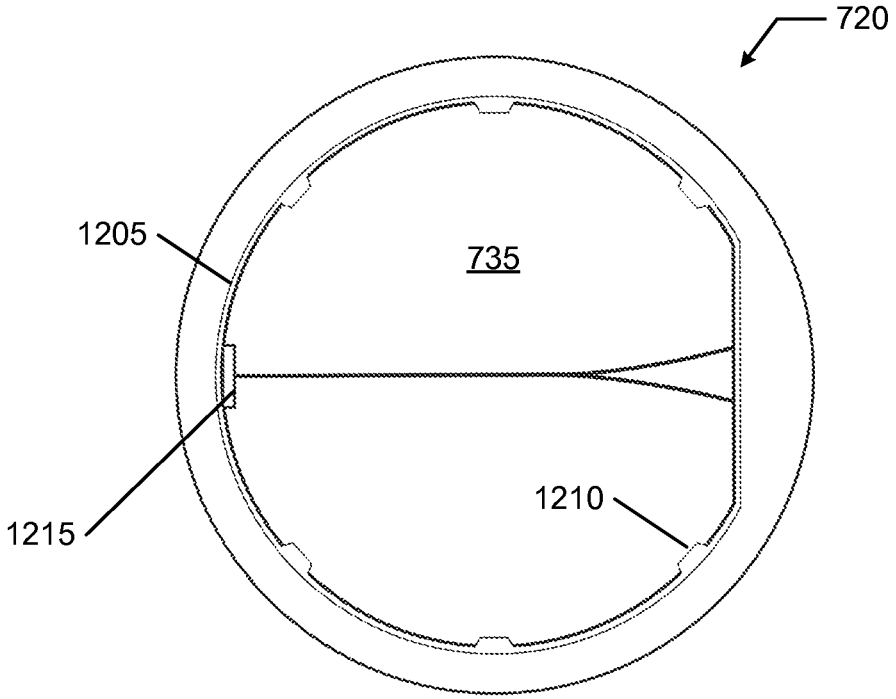

FIG. 11-FIG. 12 illustrate representative options, among other non-illustrated options, for an inset perimeter of tray insert corresponding to the spoon lid options illustrated in FIG. 9 and FIG. 10, respectively, FIG. 11 illustrates a first embodiment for an inset perimeter corresponding to the first embodiment of the spoon lid illustrated in FIG. 9; and FIG. 12 illustrates a second embodiment for an inset perimeter corresponding to the second embodiment of the spoon lid illustrated in FIG. 10. FIG. 11 includes a top plan view of tray insert 720 having an inset perimeter 1105 closely matching a folded perimeter of a spoon lid 735 from FIG. 9 disposed in a folded mode. An inset rim is disposed around inset perimeter 1105 that provides a seating ledge upon which the folded perimeter rests to maintain folded spoon lid 735 at or near the opening of tray insert 720. Spoon lid 735 includes a food engaging portion (e.g., an end portion disposed opposite of the handle portion that forms a portion of a bowl when spoon lid 735 is folded along its longitudinal axis) that is folded under the handle portion when spoon lid 735 is installed in tray insert 720. This helps to preserve the sanitary nature of the bowl portion and can allow for deployment without a further protective overwrap or protective element, such as when spoon lid 735 is installed using a press fit frictional engagement with inset perimeter 1205 to maintain spoon lid 735 in position closing the secondary top opening of tray insert 720.

FIG. 12 includes a top plan view of tray insert 720 having an inset perimeter 1205 closely matching a folded perimeter of a spoon lid 735 from FIG. 10 disposed in a folded mode. An inset rim is disposed around inset perimeter 1205 that provides a seating ledge upon which the folded perimeter rests to maintain folded spoon lid 735 at or near the opening of tray insert 720. Spoon lid 735 includes a food engaging portion (e.g., an end portion disposed opposite of the handle portion that forms a portion of a bowl when spoon lid 735 is folded along its longitudinal axis) that is folded under the handle portion when spoon lid 735 is installed in tray insert 720. This helps to preserve the sanitary nature of the bowl portion and can allow for deployment without a further protective overwrap or protective element, such as when spoon lid 735 is installed using a press fit frictional engagement with inset perimeter 1205 to maintain spoon lid 735 in position closing the secondary top opening of tray insert 720.

Further included in tray insert 720 illustrated in FIG. 12 are a series of under-cuts 1210 distributed around inset perimeter 1205. These under-cuts receive portions of the folded perimeter of spoon lid 735 and help to secure spoon lid 735 in place, in lieu of, or supplementary to, any frictional press fit engagement. Also illustrated in FIG. 12 is use of a pull tab 1215 that facilitates gripping and removal of spoon lid 735 from tray insert 720. Tab 1215 may be integrated into the handle portion of spoon lid 735 or provided as part of tray insert 720. Under-cuts 1210 and/or tab 1215 may be used with others of the embodiments of the described herein, including that illustrated in FIG. 11 and/or FIG. 13 and FIG. 14.

Figure 13:
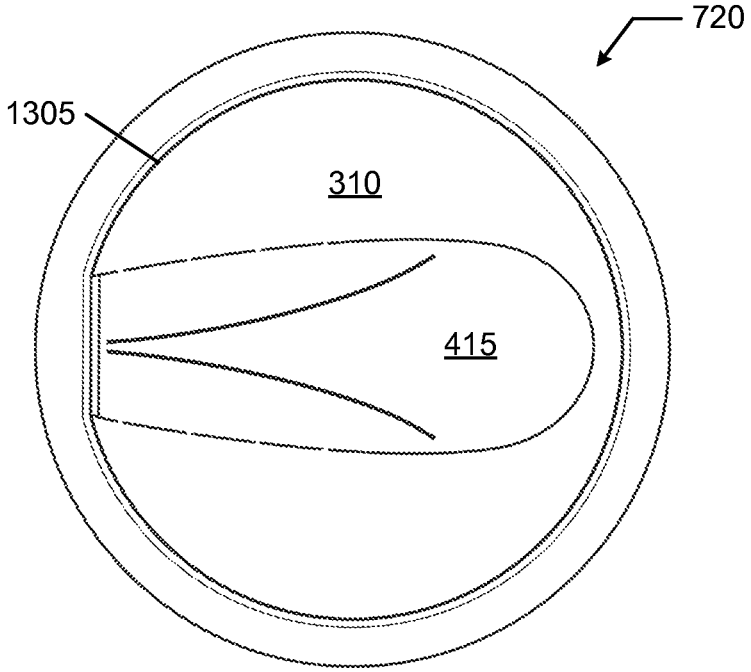
FIG. 13 illustrates a third embodiment for an inset perimeter corresponding to a popout embodiment of a constructible utensil illustrated herein, for example, FIG. 4, installed as a secondary closure system to close, secure and seal the second opening of a tray insert.

FIG. 13 illustrates a third embodiment for an inset perimeter corresponding to a popout embodiment of a constructible utensil illustrated herein, for example, FIG. 4, installed as a secondary closure system to close, secure and seal the second opening of a tray insert. FIG. 13 includes a top plan view of tray insert 720 having an inset perimeter 1305 closely matching a perimeter of a disposable constructible utensil assembly, such as disposable constructible utensil assembly 310. An inset rim is disposed around inset perimeter 1305 that provides a seating ledge upon which the perimeter rests to maintain assembly 310 at or near the opening of tray insert 720. Assembly 310 may be installed using a press fit frictional engagement with inset perimeter 1305 to maintain assembly 310 in position closing the secondary top opening of tray insert 720.

Figure 14:
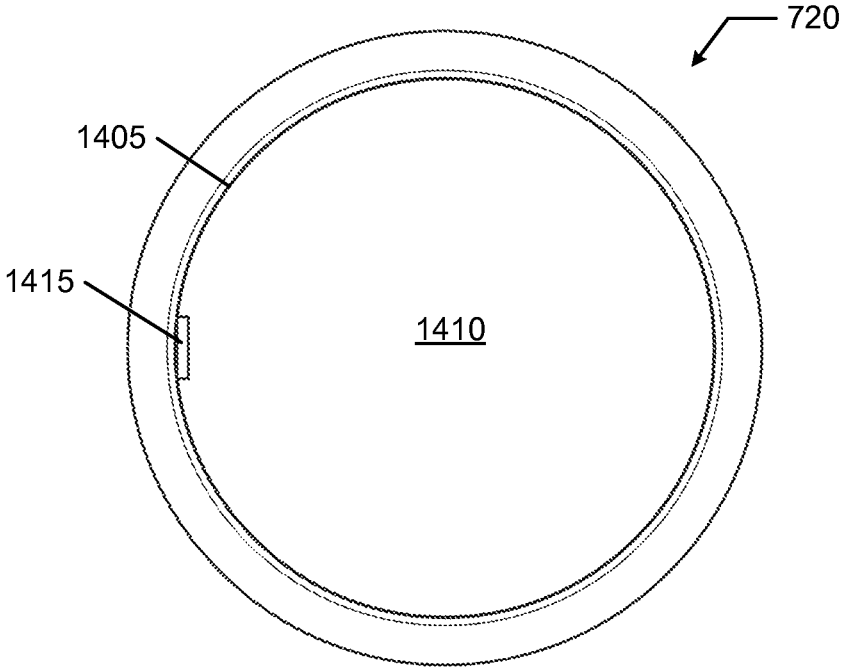
FIG. 14 illustrates a fourth embodiment for an inset perimeter corresponding to a plain blank installed as a secondary closure system to close, secure and seal the second opening of a tray insert.

FIG. 14 illustrates a fourth embodiment for an inset perimeter corresponding to a plain blank installed as a secondary closure system to close, secure and seal the second opening of a tray insert. FIG. 14 includes a top plan view of tray insert 720 having an inset perimeter 1405 closely matching a perimeter of a disposable paperboard blank 1410. An inset rim is disposed around inset perimeter 1405 that provides a seating ledge upon which the perimeter rests to maintain blank 1410 at or near the opening of tray insert 720. Blank 1410 may be installed using a press fit frictional engagement with inset perimeter 1405 to maintain blank 1410 in position closing the secondary top opening of tray insert 720. The fourth embodiment provides any utensil, constructible or not, in some other fashion other than using a spoon lid or constructible assembly. Blank 1410 is illustrated including a pull tab 1415.

Figure 15:
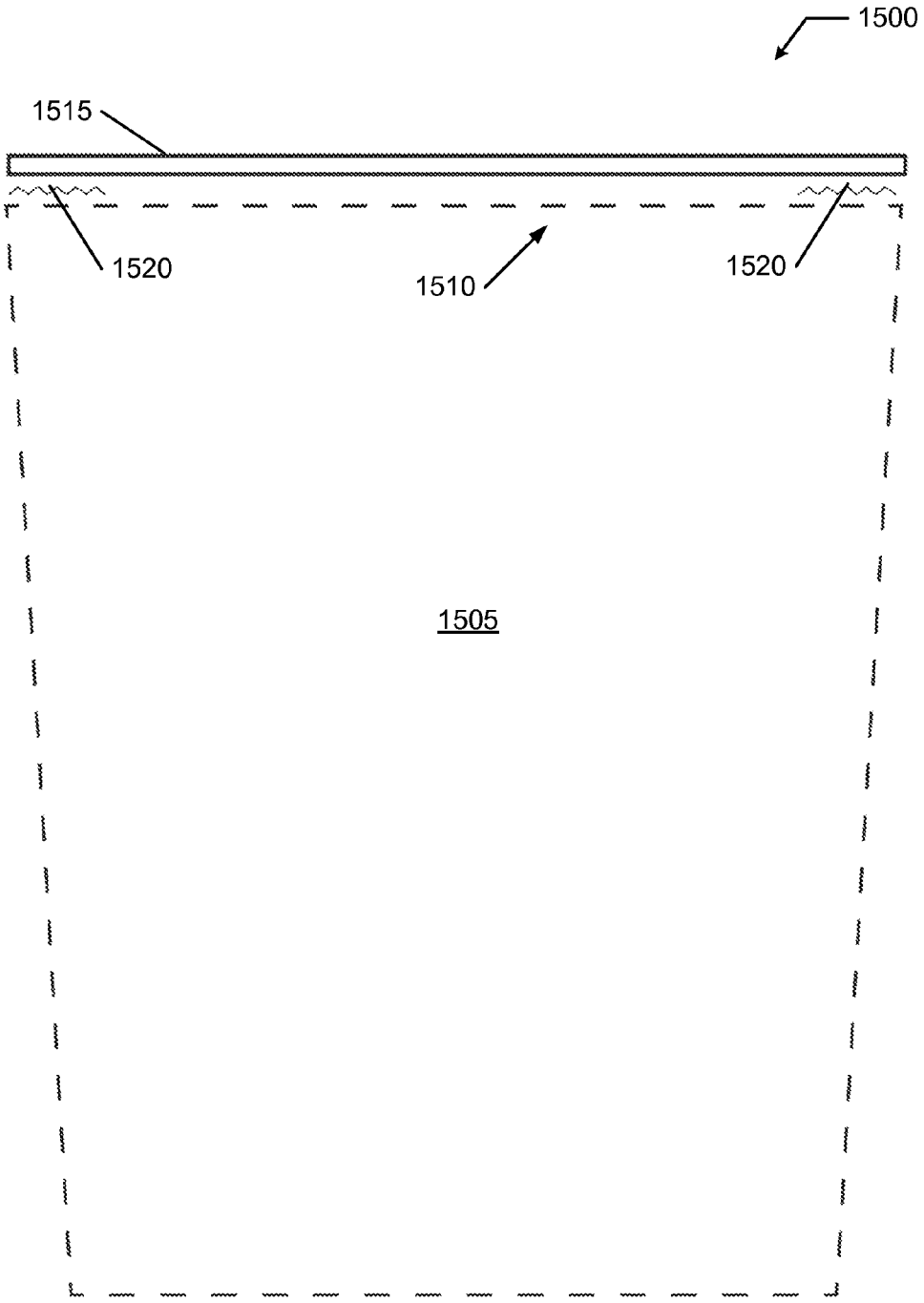
FIG. 15 illustrates a side elevation sectional view of a second embodiment for a closure system including an adhesive coupler.

FIG. 15 illustrates a side elevation sectional view of a second embodiment for a closure system 1500 including an adhesive coupler. In the embodiments described herein including use of a closure structure, for example a spoon lid, a constructible assembly, a blank disk or the like, to close an opening, for example a primary opening of a main container or a secondary opening of a secondary container, tray insert, or the like, there may be a need for an alternative system or process to maintain the closure structure in place. Closure system 1500 includes a container 1505 (primary or secondary) that includes an opening 1510 sealed with a closure structure 1515. In this implementation, a series of releasable adhesive "dots" 1520 are used to attach closure structure 1515 to the top of container 1505. Sealing in this context may vary from a food-tight seal (such as when container 1505 includes solid material) to a fluid-tight seal (such as when container 1505 includes a fluid material). The adhesive may be disposed in a continuous pattern over all or a portion of the top of container 1505 in addition to or in lieu of dots of adhesive. Some implementations may include a pull tab as described herein to aid a user in removing closure structure 1515 from the top of container 1505.

Figure 16:
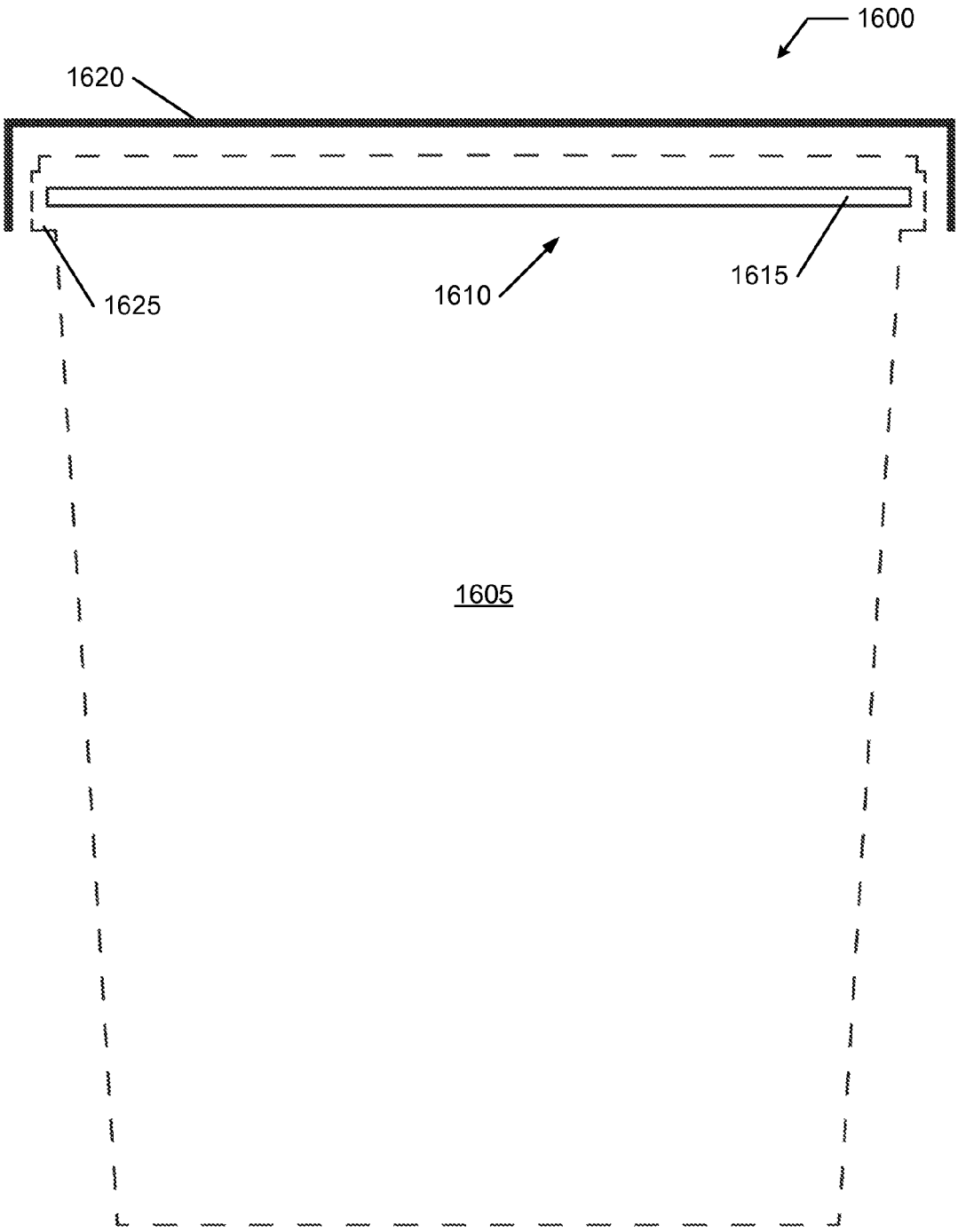
FIG. 16 illustrates a side elevation sectional view of a first embodiment for a closure system including an over cap coupler.

FIG. 16 illustrates a side elevation sectional view of a first embodiment for a closure system 1600 including an over cap coupler. In the embodiments described herein including use of a closure structure, for example a spoon lid, a constructible assembly, a blank disk or the like, to close an opening, for example a primary opening of a main container or a secondary opening of a secondary container, tray insert, or the like, there may be a need for an alternative system or process to maintain the closure structure in place.

Closure system 1600 includes a container 1605 (primary or secondary) that includes an opening 1610 sealed with a closure structure 1615 and further including an over cap coupler 1620. In this implementation, over cap 1620 may be used to attach closure structure 1615 to the top of container 1605, used as a supplemental attachment, and/or may be used as sanitary barrier. Sealing in this context (of closure structure 1615 with respect to container 1605 and/or of over cap coupler 1620 with respect to closure structure 1615 or container 1605) may vary from a food-tight seal (such as when container 1505 includes solid material) to a fluid-tight seal (such as when container 1605 includes a fluid material). Some implementations may include a pull tab as described herein to aid a user in removing over cap coupler 1620 and/or closure structure 1615 from the top of container 1605. An implementation of an over cap coupler may be used with other illustrated embodiments, including the embodiment of FIG. 15. Over cap coupler 1620 may include a physical cap, a sealing film, or a foil overwrap. Further illustrated in FIG. 16 is an example of an inset rim 1625 that supports a perimeter of closure structure 1615.

Figure 17:
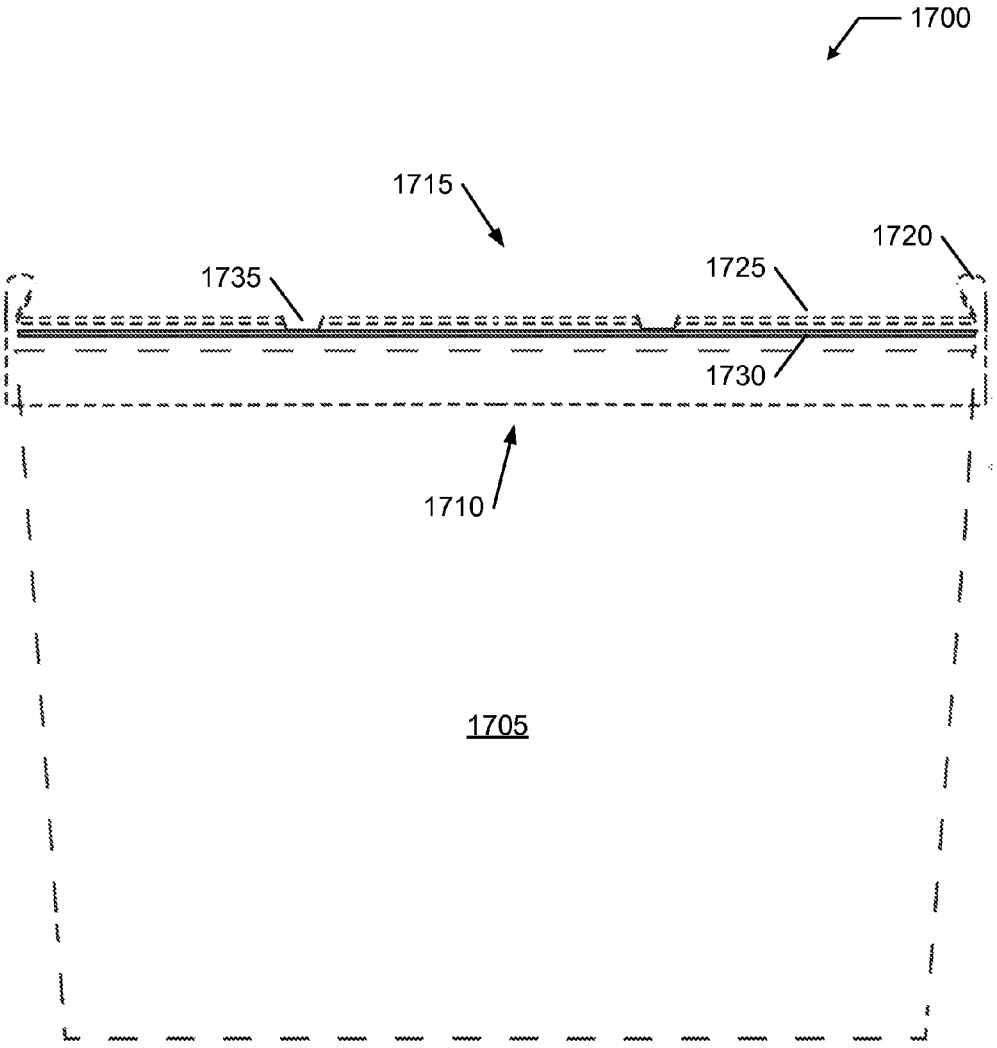
FIG. 17 illustrates a side elevation sectional view of a double wall closure system.
Figure 18:
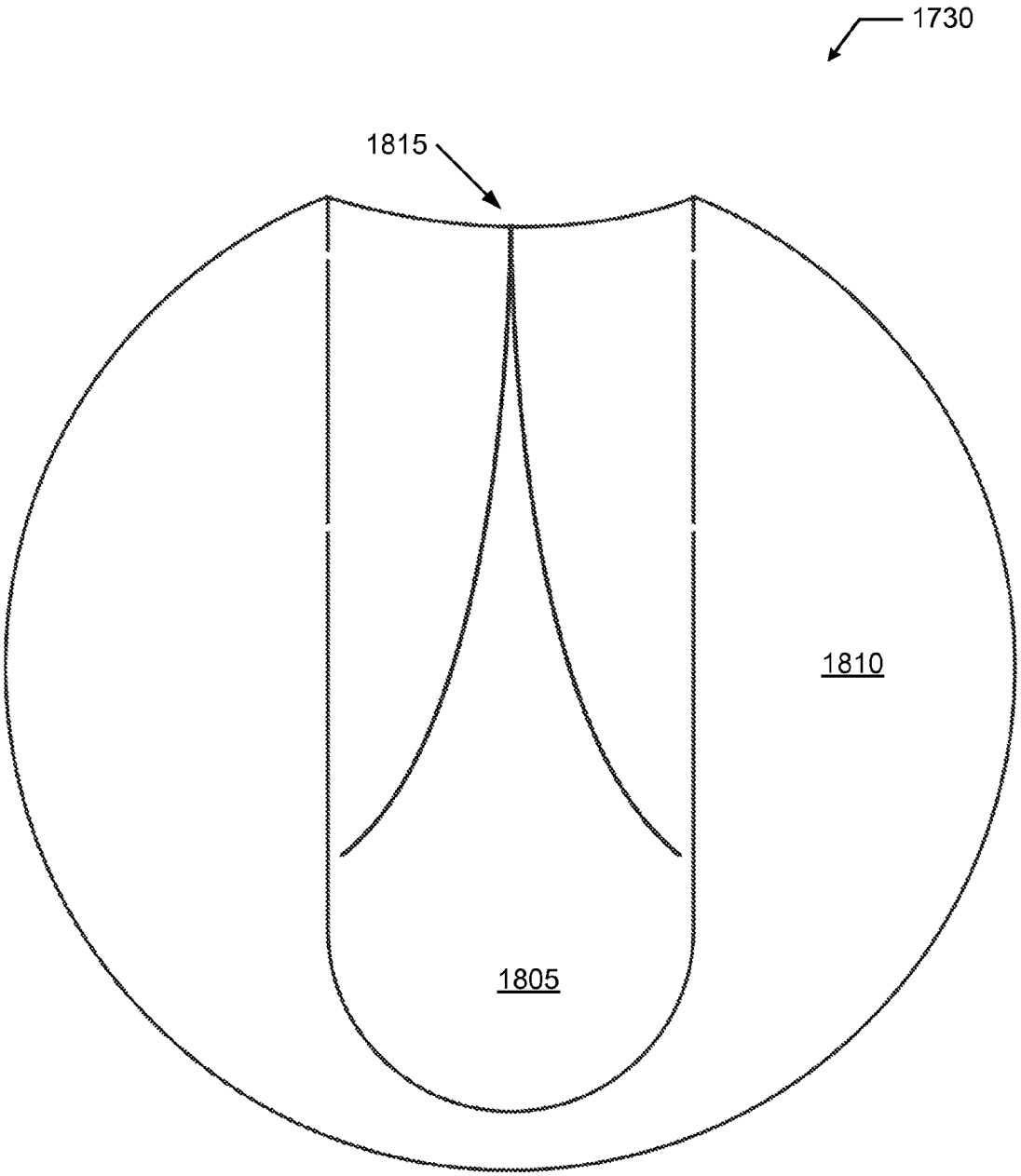
FIG. 18 illustrates a plan view of an inner wall of the double wall closure system illustrated in FIG. 17.

FIG. 17 illustrates a side elevation sectional view of a closure system 1700 having all or a portion of a wall (e.g., sidewall, lid, and/or bottom) configured as a multiwall construction and FIG. 18 illustrates a plan view of an inner wall of a double wall lid implementation. Double walls, such as for example double wall lids are used for hot products like oatmeal. These double wall lids allow for ventilation holes to be off-set allowing steam and hot/moist air to escape while inhibiting solid matter from entering into the container, and/or food from exiting, through the ventilation mechanism. A conventional solution provides each layer of the multilayer construction as solid panels with the addition of perforations or other apertures forming the ventilation mechanism. As illustrated in FIG. 17, one of these layers may be provided with a constructible utensil (a utensil-dispensing layer) allowing the manufacturer to provide a user with a utensil without addition of a new layer or structure for the utensil. This solution provides one of layers with a dual purpose: forming a portion of the double wall structure such as for the food preparation step(s) while also providing the user with a constructible utensil for consumption of the contents of the container, such as a foodstuff utensil for foodstuff or a measuring utensil for other container contents, or other constructible utensil. The constructible utensils may be of the form described herein or in the incorporated applications and patents. This is potentially very valuable to manufacturers who provide both a double wall container and/or lid and a utensil in addition to the container/lid as they can configure a portion of one of the wall layers (e.g., an inside layer of a multiwall lid or an outer layer of a multiwall container or the like) with a constructible utensil or constructible utensil assembly.

Closure system 1700 includes a container 1705 (primary or secondary) that includes an opening 1710 closed with a double wall lid 1715 attached to sidewalls of container 1705 with a rolled lid rim 1720 around a perimeter of container 1705. Double wall lid 1715 includes two layers: an outer vent lid 1725 and an inner constructible utensil assembly 1730 spaced apart from outer vent lid 1725 forming an air space therebetween. Elements 1735 represent any venting structures and it/their structure and arrangement in outer vent lid 1725 which may be implemented in many different ways from that illustrated in FIG. 17.

FIG. 18 illustrates an implementation of inner constructible utensil assembly 1730 similar to assembly 310 illustrated in FIG. 3 and FIG. 4 except as noted herein, including providing a popout constructible structure 1805 removably defined within a blank 1810 defining a removal slot 1815 (e.g., a thumb-hole) in lieu of a pull tab. An advantage assembly 1730 in the context of a double wall lid is that assembly 1730 does not require any protective laminate or film and thus may be made simpler and more cost-effectively (though some implementations may desire to continue to use a laminate, film, or other layer). There are many different configurations for structure 1805, including size, perimeter shape, nick-attachment, and scoring patterns, some of which have been disclosed herein and in the incorporated patent applications. One benefit of use slot 1815 in lieu of a pull tab is that the it can be easier for a user as well as simpler and less expensive to manufacture, particularly for some manufacturers who do have a capability to manufacture assembly 1730 (or 310) with a pull tab as described. Slot 1815 may be used in lieu of the pull tab illustrated in FIG. 3 and FIG. 4.

A simple implementation of a double-wall lid is to add an independent spoon lid, such as one of those described herein, into the lid. The spoon lid preferably has an outer perimeter closely matching an inner perimeter of the lid so that the spoon lid is secured by this press fit (e.g., frictional force) arrangement. Providing the spoon lid with the folded-over bowl portion between the handle portion and the exterior vent wall helps to protect the bowl portion and maintain it in a clean and sanitary condition.

The system and methods above has been described in general terms as an aid to understanding details of preferred embodiments of the present invention. In the description herein, numerous specific details are provided, such as examples of components and/or methods, to provide a thorough understanding of embodiments of the present invention. Some features and benefits of the present invention are realized in such modes and are not required in every case. One skilled in the relevant art will recognize, however, that an embodiment of the invention can be practiced without one or more of the specific details, or with other apparatus, systems, assemblies, methods, components, materials, parts, and/or the like. In other instances, well-known structures, materials, or operations are not specifically shown or described in detail to avoid obscuring aspects of embodiments of the present invention.

Reference throughout this specification to "one embodiment", "an embodiment", or "a specific embodiment" means that a particular feature, structure, or characteristic described in connection with the embodiment is included in at least one embodiment of the present invention and not necessarily in all embodiments. Thus, respective appearances of the phrases "in one embodiment", "in an embodiment", or "in a specific embodiment" in various places throughout this specification are not necessarily referring to the same embodiment. Furthermore, the particular features, structures, or characteristics of any specific embodiment of the present invention may be combined in any suitable manner with one or more other embodiments. It is to be understood that other variations and modifications of the embodiments of the present invention described and illustrated herein are possible in light of the teachings herein and are to be considered as part of the spirit and scope of the present invention.

It will also be appreciated that one or more of the elements depicted in the drawings/figures can also be implemented in a more separated or integrated manner, or even removed or rendered as inoperable in certain cases, as is useful in accordance with a particular application.

Additionally, any signal arrows in the drawings/Figures should be considered only as exemplary, and not limiting, unless otherwise specifically noted. Furthermore, the term "or" as used herein is generally intended to mean "and/or" unless otherwise indicated. Combinations of components or steps will also be considered as being noted, where terminology is foreseen as rendering the ability to separate or combine is unclear.

The foregoing description of illustrated embodiments of the present invention, including what is described in the Abstract, is not intended to be exhaustive or to limit the invention to the precise forms disclosed herein. While specific embodiments of, and examples for, the invention are described herein for illustrative purposes only, various equivalent modifications are possible within the spirit and scope of the present invention, as those skilled in the relevant art will recognize and appreciate. As indicated, these modifications may be made to the present invention in light of the foregoing description of illustrated embodiments of the present invention and are to be included within the spirit and scope of the present invention.

Thus, while the present invention has been described herein with reference to particular embodiments thereof, a latitude of modification, various changes and substitutions are intended in the foregoing disclosures, and it will be appreciated that in some instances some features of embodiments of the invention will be employed without a corresponding use of other features without departing from the scope and spirit of the invention as set forth. Therefore, many modifications may be made to adapt a particular situation or material to the essential scope and spirit of the present invention. It is intended that the invention not be limited to the particular terms used in following claims and/or to the particular embodiment disclosed as the best mode contemplated for carrying out this invention, but that the invention will include any and all embodiments and equivalents falling within the scope of the appended claims. Thus, the scope of the invention is to be determined solely by the appended claims.

What is claimed as new and desired to be protected by Letters Patents of the United States is:

1. A system, comprising:

a container including a base and one more sidewalls coupled to and extending from said base defining a closed volume having an opening disposed opposite from said base; and a planar utensil assembly disposed within said opening, said planar utensil assembly including a planar utensil layer defining a planar body portion and a planar utensil portion defined within, and generally coplanar with, said planar body portion and removably attached to, and selectively detachable from, said planar body portion using a set of nicks, each nick joining said planar utensil portion to said planar body portion and spaced apart from other nicks of said set of nicks;

further comprising a planar protective layer underlaying and contacting said portions of said utensil assembly, said planar protective layer coplanar with said planar utensil layer wherein said protective layer is disposed between said utensil layer and an inside of said closed volume.

2. The system of claim 1 wherein said planar protective layer is removably adhered to said utensil portion and configured so that said utensil portion may be peeled from said protective layer when detached from said body portion.

3. The system of claim 2 wherein said protective layer is configured to remain in place when said utensil portion is peeled from said protective layer.

4. A system, comprising:

a container including a base and one more sidewalls coupled to and extending from said base defining a closed volume having an opening disposed opposite from said base; and a planar utensil assembly disposed within said opening, said planar utensil assembly including a planar utensil layer defining a planar body portion and a planar utensil portion defined within, and generally coplanar with, said planar body portion and removably attached to, and selectively detachable from, said planar body portion using a set of nicks, each nick joining said planar utensil portion to said planar body portion and spaced apart from other nicks of said set of nicks;

wherein said opening has an inner perimeter, wherein said body portion has an outer perimeter complementary and conforming to said inner perimeter, and wherein said body portion is sized to close said opening;

further comprising a protective layer underlaying said portions of said utensil assembly wherein said protective layer is disposed between said utensil layer and an inside of said closed volume;

wherein said protective layer is removably adhered to said utensil portion and configured so that said utensil portion may be peeled from said protective layer when detached from said body portion.

5. The system of claim 4 wherein said protective layer is configured to remain in place when said utensil portion is peeled from said protective layer.

6. A system, comprising:

a container including a base and one more sidewalls coupled to and extending from said base defining a closed volume having an opening disposed opposite from said base; and a planar utensil assembly disposed within said opening, said planar utensil assembly including a planar utensil layer defining a planar body portion and a planar utensil portion defined within, and generally coplanar with, said planar body portion and removably attached to, and selectively detachable from, said planar body portion using a set of nicks, each nick joining said planar utensil portion to said planar body portion and spaced apart from other nicks of said set of nicks, wherein said utensil portion includes a bowl portion and a handle portion and wherein said utensil portion includes a fold axis and a surface having a plurality of curved scores on said bowl portion converging towards said fold axis on said handle portion;

further comprising a protective layer underlaying said portions of said utensil assembly wherein said protective layer is disposed between said utensil layer and an inside of said closed volume;

wherein said protective layer is removably adhered to said utensil portion and configured so that said utensil portion may be peeled from said protective layer when detached from said body portion.

7. The system of claim 6 wherein said protective layer is configured to remain in place when said utensil portion is peeled from said protective layer.

* * * * *